US007444949B2

(12) United States Patent
Park et al.

(10) Patent No.: US 7,444,949 B2
(45) Date of Patent: Nov. 4, 2008

(54) NEEDLE THREADING MACHINE

(75) Inventors: Ham-Kyu Park, Busan-si (KR); Il-Gyu Park, Busan-si (KR)

(73) Assignee: Inbro Co., Ltd. (KR)

( * ) Notice: Subject to any disclaimer, the term of this patent is extended or adjusted under 35 U.S.C. 154(b) by 0 days.

(21) Appl. No.: 11/571,676

(22) PCT Filed: Jul. 5, 2005

(86) PCT No.: PCT/KR2005/002142

§ 371 (c)(1),
(2), (4) Date: Jan. 5, 2007

(87) PCT Pub. No.: WO2006/004372

PCT Pub. Date: Jun. 12, 2006

(65) Prior Publication Data

US 2007/0227424 A1 Oct. 4, 2007

(30) Foreign Application Priority Data

Jul. 5, 2004 (KR) ..... 10-2004-0052098
Jul. 5, 2005 (KR) ..... 10-2005-0060007

(51) Int. Cl.
*D05B 87/02* (2006.01)
*D05B 85/00* (2006.01)

(52) U.S. Cl. ..... 112/225

(58) Field of Classification Search ..... 112/225, 112/302; 223/99
See application file for complete search history.

(56) References Cited

U.S. PATENT DOCUMENTS 5,086,718 A 2/1992 Ogawa
5,090,345 A 2/1992 Ogawa
6,564,731 B2 * 5/2003 Sano et al. ..... 112/225
6,959,656 B2 * 11/2005 Fukao ..... 112/225
6,973,888 B2 * 12/2005 Yoshikazu ..... 112/225

(Continued)

FOREIGN PATENT DOCUMENTS

JP 5483956 7/1979

(Continued)

OTHER PUBLICATIONS

International Search Report; PCT/KR2005/002142; Date: Oct. 25, 2005.

(Continued)

*Primary Examiner*—Ismael Izaguirre
(74) *Attorney, Agent, or Firm*—Cantor Colburn LLP

(57) ABSTRACT

Disclosed is a needle threading machine of putting a thread through an eye of a needle provided in a sewing machine, the needle treading machine comprising a thread supplying unit supplying the thread along a predetermined thread guiding path; a thread catcher comprising a hook to hook the thread, and a hook supporter extended from the hook and supporting the hook; a thread catcher driver driving the thread catcher to reciprocate allowing the hook to be inserted in and return from the eye of the needle; and a thread guiding unit hooking the thread supplied from the thread supplying unit on the hook passed through the eye of the needle. Thus, the present invention provides a needle threading machine, in which a thread is stably hooked on a hook, thereby reducing a defective needle threading work and enhancing productivity.

7 Claims, 30 Drawing Sheets

U.S. PATENT DOCUMENTS 7,293,513 B2 * 11/2007 Fluckiger et al. ..... 112/225

FOREIGN PATENT DOCUMENTS

JP 751507 11/1995

KR 20020018801 3/2002

OTHER PUBLICATIONS

PCT Written Opinion of the International Searching Authority; PCT/KR2005/002142; Date: Oct. 25, 2005.

All the references cited in the search report are listed above.

* cited by examiner

NEEDLE THREADING MACHINE

FIELD OF THE INVENTION

The present invention relates to a needle threading machine for a sewing machine, and more particularly, to a needle threading machine having an improved structure of hooking a thread on a hook.

BACKGROUND ART

In a sewing machine, an automatic embroidering machine or the like, there is unavoidably needed a needle threading work that passes a thread through an eye of a needle provided in a lower part of a head stem in order to change an upper thread.

Such a needle threading work takes much time and is inconvenient. Particularly, the thread is frequently changed in the case of the automatic embroidering machine that uses various colored threads, thereby causing the loss of work time.

Accordingly, there has been disclosed a needle threading machine in Korean Patent Application No. 2000-52077. In this needle threading machine, a hook is provided in the end of a thread catcher and holds the thread. Further, the thread catcher is reciprocated between the needle and a predetermined position spaced from the needle, so that the hook passes through the eye of the needle, thereby automatically performing the needle threading work.

However, in the conventional needle threading machine, the hook holding the thread is made of a fine wire to easily pass through the eye of the needle. While the needle moves down in the state that the hook holds the thread, the thread is released from the hook, thereby getting the thread through the eye of the needle. Therefore, friction between the thread passing through the eye of the needle and the hook causes damage on the thread. Also, because the hook is repeatedly deformed, the durability of the hook is decreased and the hook is damaged. Further, the thread catcher should be frequently replaced with new one. Further, the needle threading work is performed in the state that the thread is unstably hooked on the hook, thereby causing the defective needle threading work and decreasing productivity

DISCLOSURE OF INVENTION

Accordingly, it is an aspect of the present invention to provide a needle threading machine, in which a thread is stably hooked on a hook, thereby reducing a defective needle threading work and enhancing productivity.

The foregoing and other aspects of the present invention are achieved by providing a needle threading machine of putting a thread through an eye of a needle provided in a sewing machine, the needle treading machine comprising a thread supplying unit supplying the thread along a predetermined thread guiding path; a thread catcher comprising a hook to hook the thread, and a hook supporter extended from the hook and supporting the hook; a thread catcher driver driving the thread catcher to reciprocate allowing the hook to be inserted in and return from the eye of the needle; and a thread guiding unit hooking the thread supplied from the thread supplying unit on the hook passed through the eye of the needle.

According to an aspect of the present invention, the needle threading machine further comprises a needle bar to which the needle is mounted, a lifting unit to lift up the needle bar from a sewing work section to a needle threading section for putting the thread through the eye of the needle, and a lifting driver to drive the lifting unit to be lifted up and down, wherein the thread catcher driver drives the hook to pass through the eye of the needle and the thread guiding unit hooks the thread on the hook passed through the eye of the needle as the lifting unit is lifted up within the needle threading section.

According to an aspect of the present invention, the thread catcher driver comprises a main body; a thread catcher supporter provided to reciprocate relative to the main body, and supporting the thread catcher; a supporting shaft supporting the thread catcher supporter to reciprocate relative to the main body; and a reciprocating unit allowing the thread catcher supporter to reciprocate.

According to an aspect of the present invention, the reciprocating unit comprises a driving pin provided in the lifting unit; and a driving link having a reciprocating profile formed at a predetermined angle transversely to a lifting direction of the needle to contact the driving pin as the lifting unit is lifted up within the needle threading section, and allowing the hook to be inserted in and return from the eye of the needle by pressing and releasing the thread catcher supporter as the driving pin moves contacting the reciprocating profile.

According to an aspect of the present invention, the thread guiding unit comprises a rotation bracket rotatably coupled to the main body, and formed with a thread guiding profile; a rotation pin protruding from the thread catcher supporter, contacting and moving along the thread guiding profile of the rotation bracket, and rotating the rotation bracket by reciprocation of the thread catcher supporter; a thread guiding bracket to take up the thread supplied from the thread supplying unit and hook the thread on the hook; and an auxiliary link connecting the rotation bracket with the thread guiding bracket, and transferring the rotation of the rotation bracket to the thread guiding bracket.

According to an aspect of the present invention, the thread guiding unit comprises a rotation bracket rotatably coupled to the main body; a thread guiding bracket to take up the thread supplied from the thread supplying unit and hook the thread on the hook; an auxiliary link connecting the rotation bracket with the thread guiding bracket, and transferring the rotation of the rotation bracket to the thread guiding bracket; and a rotation bracket elastic member provided between the main body and the rotation bracket, and elastically urging the rotation bracket to rotate allowing the thread taken up in the thread guiding bracket to be on the hook.

According to an aspect of the present invention, the needle threading machine further comprises a lifting rod formed with a groove on an outer circumference thereof, and moving close to and apart from the rotation bracket by being lifted up and down along with the lifting unit; a lifting clutch comprising a protrusion locked to the groove, and an extended part extended from the protrusion, and controlling the lifting operation of the lifting rod; and a clutch operator formed with a clutch cam profile being in contact with and apart from the extended part, and operating the lifting clutch to return the thread guiding bracket to an original position thereof after getting the hook holding the thread out of the eye of the needle as the protrusion is released from the groove by moving the extended part to be in contact with the clutch cam profile when the lifting rod is lifted down.

MODES FOR CARRYING OUT THE INVENTION

Hereinbelow, preferred embodiments of the present invention will be described with reference to accompanying drawings.

In the following embodiments, like elements refer to like elements throughout, and repetitive descriptions will be avoided as necessary.

Figure 1:
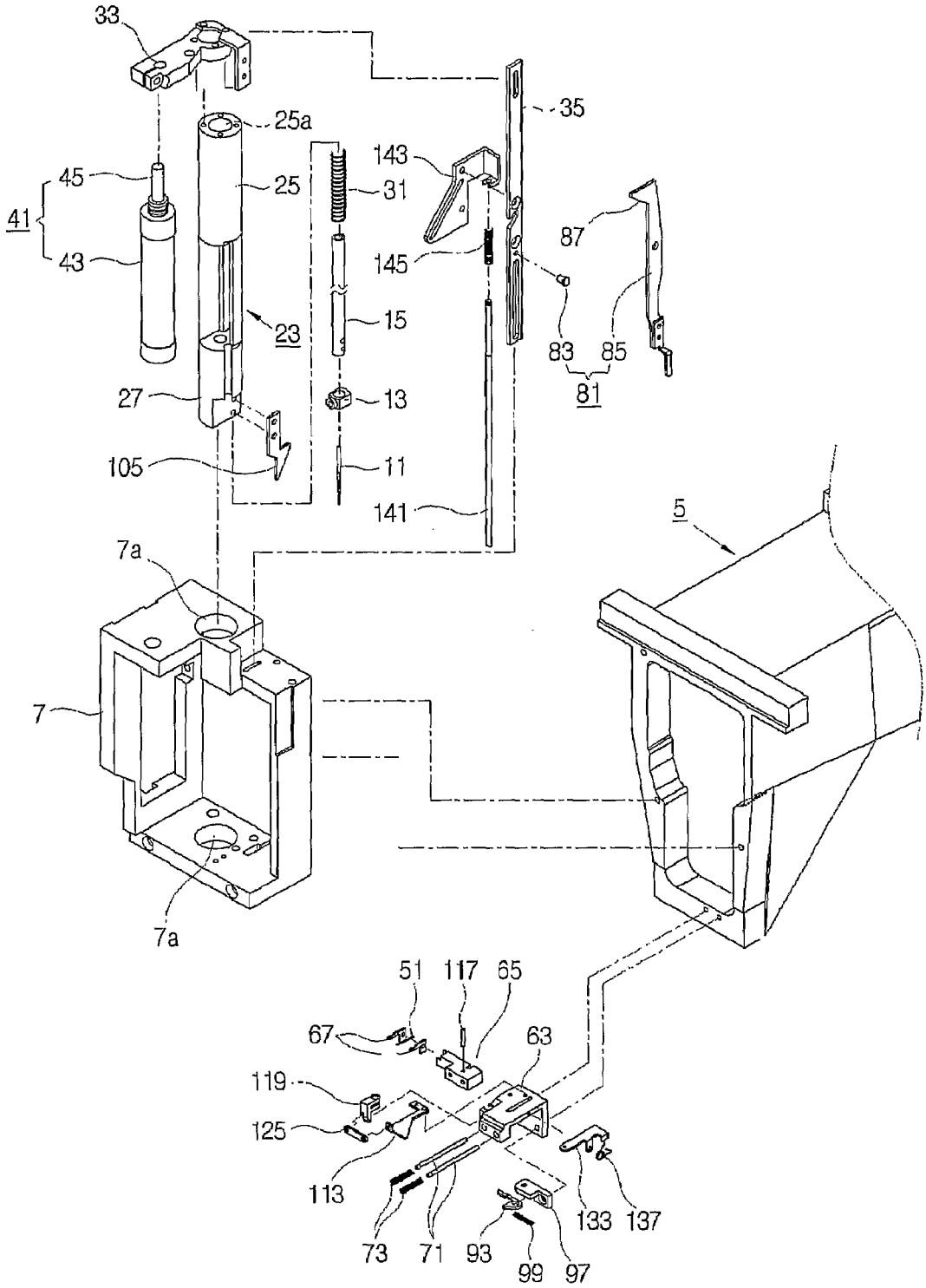
FIG. 1 is an exploded perspective view of a needle threading machine according to a first embodiment of the present invention.
Figure 2:
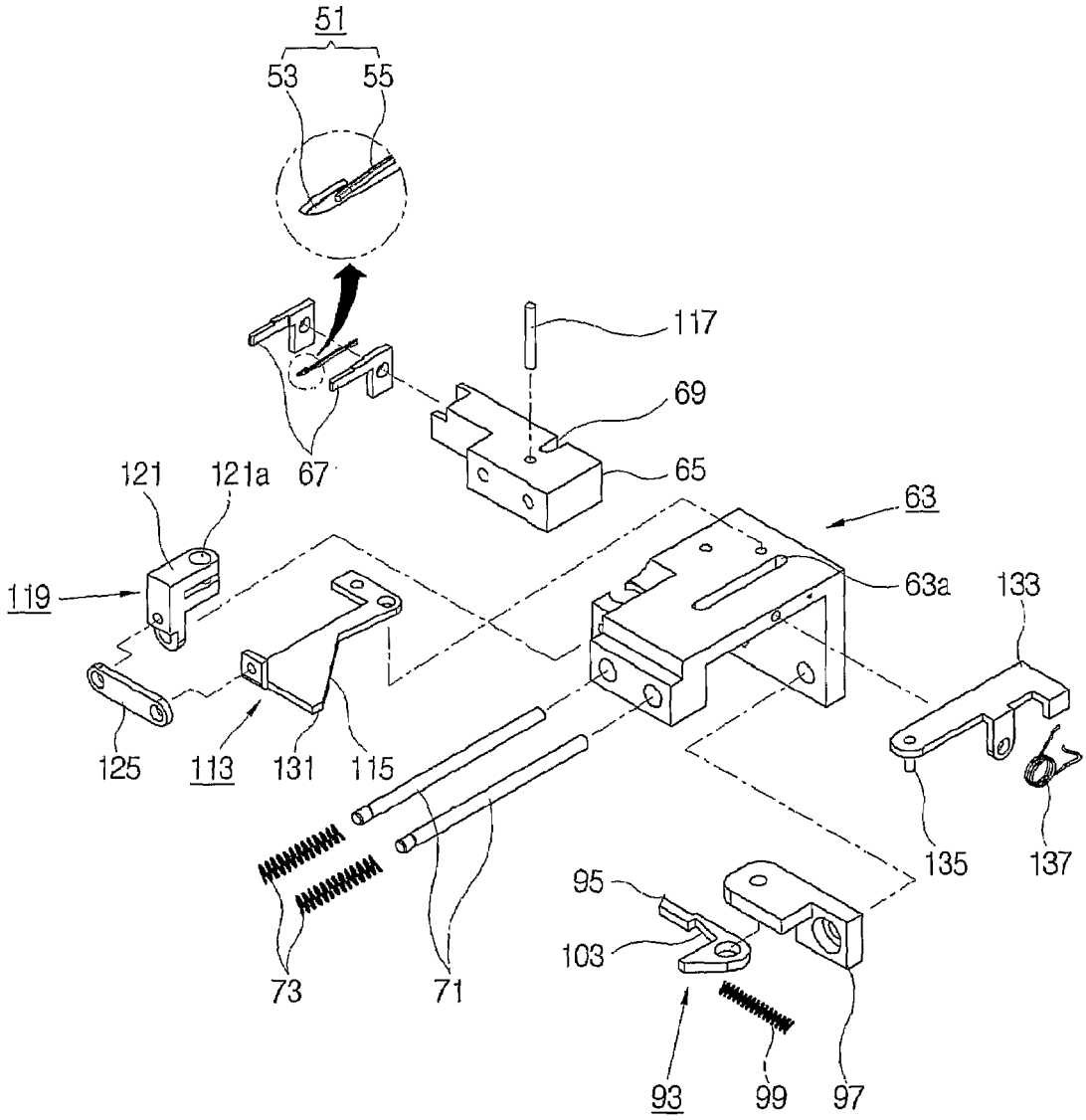
FIG. 2 is a partially enlarged exploded perspective view of the needle threading machine of FIG. 1.

As shown in FIGS. 1 and 2, a needle threading machine 1 according to a first embodiment of the present invention includes a needle 11 threaded with a thread supplied from a thread supplying unit 9 along a predetermined thread guiding path (not shown).

The needle 11 reciprocates within a predetermined sewing work section passing through a needle plate (not shown), and is mounted to an end of a needle bar 15 by a needle holder 13.

The needle bar 15 is shaped like a tube-body, and controllably connected to a needle bar driver (not shown) reciprocating within a predetermined section by a clutch (not shown). Thus, the needle bar 15 is connected to the needle bar driver through the clutch, so that the needle 11 mounted to the end of the needle bar 15 reciprocates within the sewing work section by the reciprocating operation of the needle bar driver, thereby performing a sewing operation.

Figure 8A:
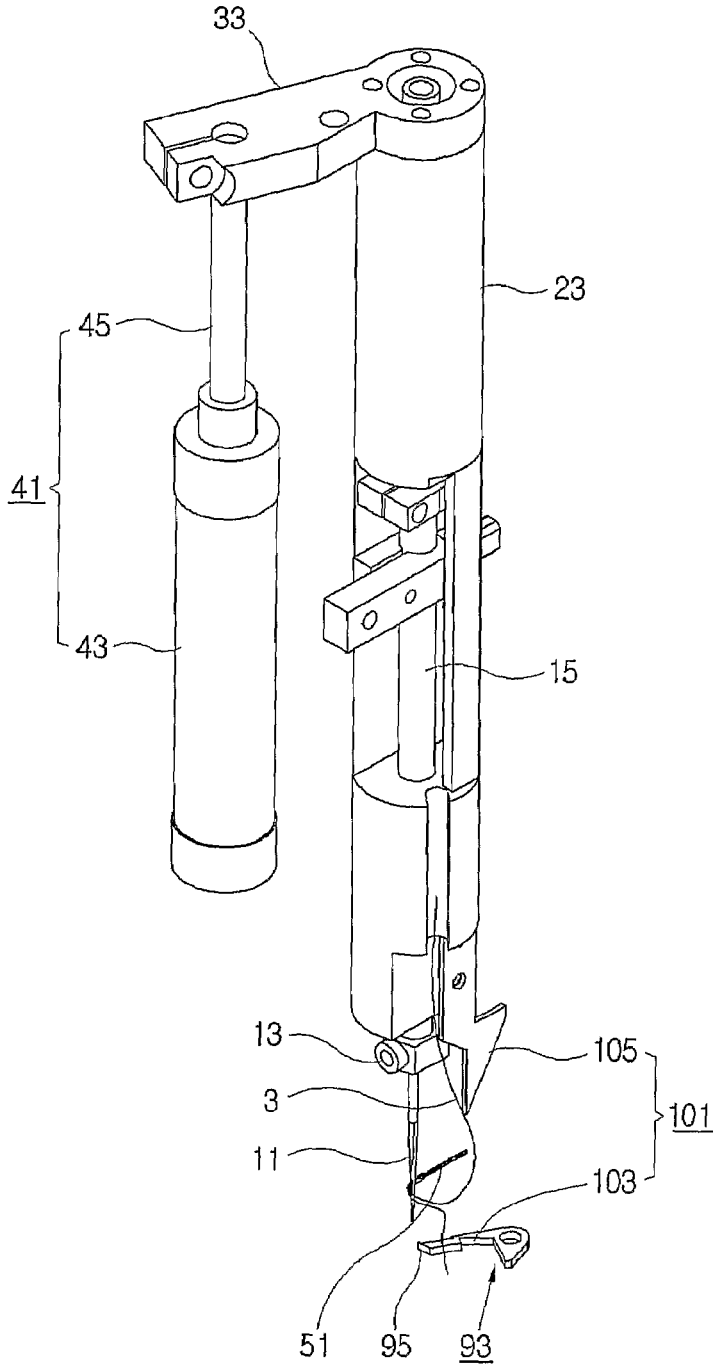
FIGS. 8A and 8B are a partially enlarged perspective view and a bottom view illustrating an operation of a thread transporting unit.
Figure 8B:
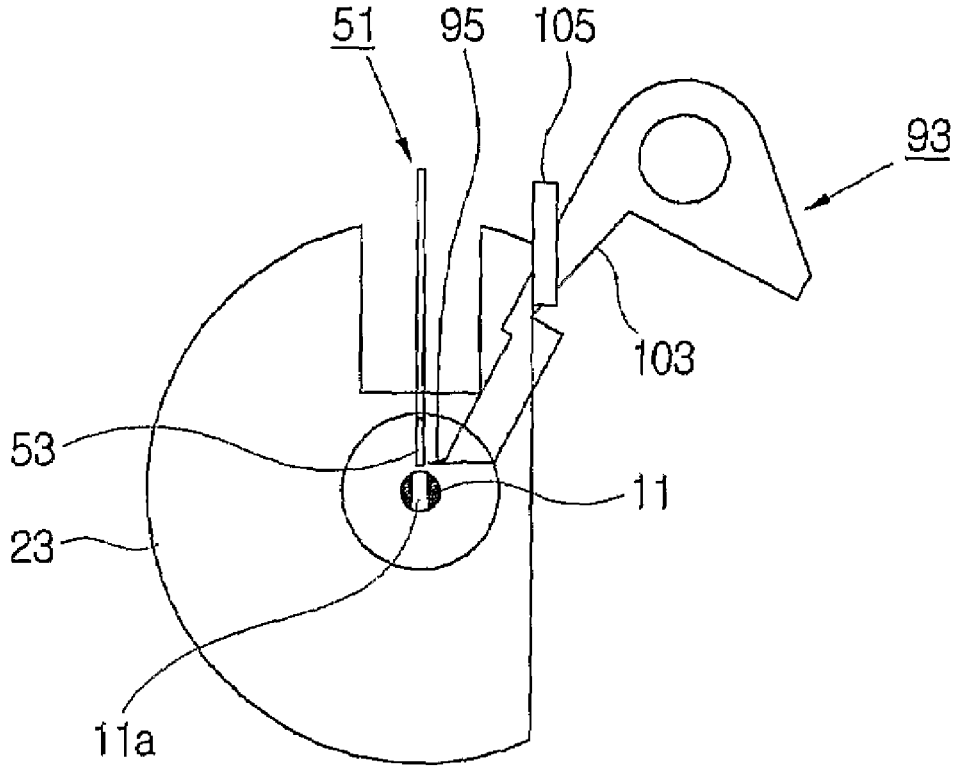

Meanwhile, the needle threading machine 1 according to an embodiment of the present invention includes a lifting unit 21 to lift up the needle bar 15 so that the needle 11 gets out of the sewing work section and is lifted up to a needle threading section to thereby pass the thread 3 through an eye 11*a* (refer to FIG. 8B) of the needle 11; and a lifting driver 41 to drive the lifting unit 21 to be lifted up and down.

The lifting unit 21 includes a needle bar bush 23 to which the needle bar 15 is movably coupled, a connecting link 33 connecting the needle bar bush 23 and the lifting driver 41, and a lifting bar 35 coupled to a first side of the connecting link 33 and lifted up and down along with the needle bar bush 23.

The needle bar bush 23 includes a pair of guides 25 and 27 movably coupled to a through hole 7*a* of a head stem 7, partially accommodating the needle bar 15, and guiding the needle bar 15 to be lifted up and down. Hereinafter, for convenience, the guide placed in an upper side of the needle bar bush 23 will be called an upper guide 25, and the guide placed in a lower side of the needle bar bush 23 will be called a lower guide 27. The pair of guides 25 and 27 are aligned on the same axis and spaced from each other. Particularly, the upper guide 25 is formed with an elastic member accommodating groove 25*a* to partially accommodate a needle bar elastic member 31 therein.

The needle bar elastic member 31 is disposed along an outer circumference of the needle bar 15, and accommodated in the elastic member accommodating groove 25*a* of the upper guide 25, thereby elastically connecting the needle bar 15 with the needle bar bush 23. Further, the needle bar elastic member 31 absorbs shock of the needle bar 15 while the needle 11 performs the sewing operation.

The connecting link 33 has a first end connected to a free end of a cylinder rod 45 of the lifting driver 41 (to be described later), and a second end connected to a top surface of the upper guide 25 of the needle bar bush 23.

The connecting link 33 is coupled to the lifting bar 35 shaped like a long bar at a first side, and the lifting bar 35 is disposed being spaced from and parallel to the needle bar bush 23.

The lifting driver 41 includes a cylinder main body 43 operated by hydraulic pressure, and a cylinder rod 45 expanded and retracted by the hydraulic pressure operation of the cylinder main body 43 to reciprocate. The cylinder main body 43 is supported by the head stem 7, and the cylinder rod 45 is disposed being spaced from and parallel to the needle bar bush 23.

Thus, when the cylinder main body 43 of the lifting driver 41 drives the cylinder rod 45 to reciprocate, the reciprocation of the cylinder rod 45 is transferred to the needle bar bush 23 and the lifting bar 35 through the connecting link 33, so that the needle bar bush 23 and the lifting bar 35 are lifted up and down correspondingly.

In this embodiment, the hydraulic pressure cylinder operated by the hydraulic pressure is used as the lifting driver, but not limited to. Alternatively, a motor, a cam device, a solenoid, etc. may be employed as the lifting driver.

In the meantime, the needle threading machine 1 according to an embodiment of the present invention includes a thread catcher 51 that has a hook 53 to hook the thread 3 and a hook supporter 53 to support the hook 53 and puts the thread 3 through the eye 11*a* of the needle 11; a thread catcher driver 61 to drive the thread catcher 51 to reciprocate; and a thread transporting unit 91 to take up the thread 3 caught in the hook 53 and transport the thread 3 along the hook supporter 55.

The thread catcher 51 includes the hook 53 to hook the thread 3, and the hook supporter 55 extended from the hook 53 and supporting the hook 53.

The hook 53 is shaped like a hasp, and has a first end supported by the hook supporter 55 shaped like a long bar having a relatively large cross-section. Thus, the hook supporter 55 has higher durability than the hook 53.

Alternatively, the thread catcher may be achieved by a single wire, in which an end of the single wire forming the hook supporter is formed to have a hasp shape, thereby forming the hook to hook the thread.

The thread catcher driver 61 includes a main body 63, a thread catcher supporter 65 to support the thread catcher 51, a pair of supporting shafts 71 to support the thread catcher supporter 65 to reciprocate relative to the main body 63, and a reciprocating unit 81 allowing the thread catcher supporter 65 to reciprocate.

The main body 63 is shaped like a block opened at one side, and supported by a supporting frame 5 supporting the head stem 7. On the main body 63 is formed a slot 63*a* to prevent interference while a rotation pin 117 (to be described later) reciprocates.

The thread catcher supporter 65 is shaped like a block, reciprocates relative to the main body 63, and has a first end protruding from the main body 63. The first end of the thread catcher supporter 65 protruding from the main body 63 supports the thread catcher 51 so that the hook 53 is oriented toward the eye 11*a* of the needle 11. Further, a pair of hook guides 67 is provided in the opposite sides of the hook 53 and guides the hook 53 to move so that the hook 53 can smoothly pass through the eye 11*a* of the needle 11. Here, the hook guide 67 is supported by the thread catcher supporter 65. Further, the thread catcher supporter 65 is formed with a link accommodating groove 69 partially accommodating a driving link 85 therein.

The thread catcher supporter 65 is supported by and reciprocates on the pair of supporting shafts 71 provided in the main body 63. Further, a supporting shaft elastic member 73 is provided between an inner wall of the main body 63 and the thread catcher supporter 65, and placed in an outer circumference of the supporting shaft 71. The supporting shaft elastic member 73 urges the hook 53, which is inserted in the eye 11*a* of the needle 11 and hooks the thread 3, to return back from the eye 11*a* of the needle 11. Alternatively, the thread catcher supporter 65 may be supported by a single supporting shaft 71 and reciprocate.

The reciprocating unit 81 for reciprocating the thread catcher supporter 65 includes a driving pin 83 protruding from a first side of the lifting bar 35 of the lifting unit 21, and the driving link 85 having a reciprocating profile 87 contacting the driving pin 83, and to drive the hook 53 to be inserted in and returned from the eye 11*a* of the needle 11 by pressing and releasing the thread catcher supporter 65 as the driving pin 83 contacts and moves along the reciprocating profile 87.

The driving link 85 is rotatably provided in the head stem 7 so as to move close to and apart from the thread catcher supporter 65. In an upper part of the driving link 85 is provided the reciprocating profile 87 that contacts the driving pin 83 as the needle bar bush 23 and the lifting bar 35 of the lifting unit 21 are lifted up within the needle threading section. Here, the reciprocating profile 87 is disposed at a predetermined angle transversely to a lifting direction of the needle 11.

Therefore, when the needle bar bush 23 and the lifting bar 35 are lifted up within the needle threading section by the operation of the lifting driver 41, the driving pin 83 contacts the reciprocating profile unit 87 placed in the upper part of the driving link 85 and is lifted up along the reciprocating profile unit 87. At the same time, a lower part of the driving link 85 is rotated toward the thread catcher supporter 65 and presses the thread catcher supporter 65, so that the thread catcher supporter 65 goes from the back to the front of the main body 63 along the supporting shaft 71, thereby putting the hook 53 through the eye 11*a* of the needle 11.

Here, as the reciprocating unit 81, a hydraulic cylinder, a motor, a cam device, a solenoid, or etc. may be directly connected to the thread catcher supporter 65 so as to reciprocate the thread catcher supporter 65, thereby allowing the hook 53 to be inserted in and taken out from the eye 11*a* of the needle 11.

The thread transporting unit 91 takes up the thread 3 caught in the hook 53 and transports the thread 3 along the hook supporter 55. The thread transporting unit 91 includes a thread transporting bracket 93 taking up the thread caught in the hook 53 passing through the eye 11*a* of the needle 11 and transporting the taken-up thread 3 to the hook supporter 55, and a thread transporting driver 101 to drive the thread transporting bracket 93.

The thread transporting bracket 93 is rotatably provided in the main body 63 in parallel with a plane formed by the eye 11*a* and the hook 53. The thread transporting bracket 93 is provided with a thread taking-up unit 95 to take up the thread 3 passing through the eye 11*a* of the needle 11 and caught in the hook 53. The thread transporting bracket 93 is rotatably coupled to an auxiliary supporter 97 provided inside the main body 63. Further, the thread transporting bracket 93 is elastically supported by a thread transporting bracket elastic member 99 to the auxiliary supporter 97.

The thread transporting driver 101 includes a thread transporting profile 103 formed in a first side of the thread transporting bracket 93, and a thread releasing bracket 105 contacting and moving along the thread transporting profile 103 and rotating the thread transporting bracket 93 as the needle bar 15 is lifted down.

The thread transporting profile 103 is provided in the first side of the thread transporting bracket 93, and cut away by a predetermined width transversely to a lengthwise direction of the thread transporting bracket 93 so that an end of a thread releasing bracket 105 is lifted up and down contacting the thread transporting profile 103.

The thread releasing bracket 105 is coupled to the lower part of the needle bar bush 23, and its end has an triangular cross-section and contacting the thread transporting profile 103. The thread releasing bracket 105 moves to be spaced from and in contact with the thread transporting profile 103 formed in the thread transporting bracket 93 as the needle bar 15 and the needle bar bush 23 are lifted up and down.

Therefore, when the needle 11 is lifted down from the needle threading section to the sewing work section, the needle bar 15 and the needle bar bush 21 are lifted down, and the thread releasing bracket 105 is also lifted down contacting the thread transporting profile 103 formed in the thread transporting bracket 93. At the same time, the thread transporting bracket 93 is rotated toward the back of the main body 63, thereby taking up the thread 3 caught in the hook 53 and transporting the thread 3 passing through the eye 11*a* of the needle 11, away from the hook 53 along the hook supporter 55. In this embodiment, after the hook 53 is returned from the eye 11*a* of the needle 11, the thread 3 caught in the hook 53 is transported along the hook supporter 55 and moves away from the hook 53, but not limited to. Alternatively, the thread 3 caught in the hook 53 may move to an away position, being spaced from the hook supporter 55 without being draped on the hook supporter 55.

Meanwhile, the needle threading machine 1 according to an embodiment of the present invention further includes a thread guide unit 111 to guide the thread 3 supplied from the thread supplying unit 9 to the plane formed by the eye 11*a* of the needle 11 and the hook 53, thereby hooking the thread 3 on the hook 53.

The thread guide unit 111 includes a rotation bracket 113 formed with a predetermined thread guiding profile 115, the rotation pin 117 contacting and moving along the thread guiding profile 115 of the rotation bracket 113, a thread guiding bracket 119 to guide the thread 3 supplied from the thread supplying unit 9 to be taken up and hooked on the hook 53, and an auxiliary link 125 connecting the rotation bracket 113 with the thread guiding bracket 119 and transferring rotation of the rotation bracket 113 to the thread guiding bracket 119.

The rotation bracket 113 is rotatably coupled to a top surface of the main body 63. The rotation bracket 113 is formed with the thread guiding profile 115 at a predetermined angle transversely to a lengthwise direction of the rotation bracket 113.

The rotation pin 117 protrudes from a top surface of the thread catcher supporter 65, and contacts and moves along the thread guiding profile 115 of the rotation bracket 113 by the reciprocation of the thread catcher supporter 65, thereby rotating the rotation bracket 113. Further, the rotation pin 117 reciprocates along the slot 63*a* of the main body 63, so that there is no interference with the main body 63.

The thread guiding bracket 119 includes a pair of thread guides 121 protruding from a first end thereof and spaced from each other. Each thread guide 121 is formed with a thread through hole 121*a* to take up the thread 3 supplied from the thread supplying unit 9 and passing therethrough. Further, the thread guiding bracket 119 has a second end connected to the auxiliary link 125.

The auxiliary link 125 connects the rotation bracket 113 with the thread guiding bracket 119, and transfers the rotation of the rotation bracket 113 to the thread guiding bracket 119. As the auxiliary link 125 transfers the rotation of the rotation bracket 113 to the thread guiding bracket 119 to rotate, the thread 3 passing through and taken up by the thread through hole 121*a* of the thread guiding bracket 119 is placed on the plane formed by the eye 11*a* of the needle 11 and the hook 53.

Meanwhile, the rotation bracket 113 is formed with a projection 131 extended from an end of the thread guiding profile 115. The projection 131 contacts a stopper 135 formed in the lower part of the lifting bracket 133, thereby preventing the rotation bracket 113, which is rotated so that the thread 3 is placed on the plane formed by the eye 11*a* and the hook 53, from returning to its original position.

The lifting bracket 133 is placed in the upper part of the rotation bracket 113, and elastically supported by a stopper elastic member 137 elastically urging the stopper 135 to press the upper part of the main body 63. The stopper elastic member 137 has a first end supported by the lifting bracket 133, and a second end supported by the main body 63. In an upper part of the lifting bracket 133 corresponding to the stopper 135 is provided a lifting rod 141 standing thereon. The lifting rod 141 moves being in contact with and spaced from the upper part of the lifting bracket 133 by the lifting operation of the lifting bar 135, so that the stopper 135 provided in an lower part of the lifting bracket 133 moves to be apart from and in contact with the projection 131.

The lifting rod 141 is shaped like a bar, and movably coupled to an auxiliary bracket 143 connected to the lifting bar 35. The lifting rod 141 has a lower part moving to be in contact with and spaced from the upper part of the lifting bracket 133, and an upper part mounted with a lifting rod elastic member 145 elastically pressing the second end of the lifting bracket 133 when the lifting bar 35 is lifted down within the needle threading section.

The lifting rod 141 is lifted up along with the needle bar bush 23 when the needle bar bush 23 is lifted up to a predetermined top dead point within the needle threading section. At this time, the lower part of the lifting rod 141 is spaced from the upper part of the lifting bracket 133, so that the lifting bracket 133 is released from the pressure. At the same time, the stopper 135 provided in the lifting bracket 133 presses a top surface of the rotation bracket 113 by the elasticity of the stopper elastic member 137.

Further, when the thread 3 taken up by the thread guiding bracket 119 is rotated to be placed on the plane formed by the eye 11*a* and the hook 53, i.e., when the rotation bracket 113 is rotated at a predetermined angle, the stopper 135 is spaced from the top surface of the rotation bracket 113 and contacts the top surface of the main body 63 by the elasticity of the stopper elastic member 137, so that the stopper 135 closely contacts the projection 131 of the rotation bracket 113, thereby preventing the rotation bracket 113 from returning to its original position.

On the other hand, when the needle 11 is lifted down from the needle threading section to the sewing work section, the lifting rod 141 is lifted down along with the needle bar bush 23, and the lower part of the lifting rod 141 presses the upper part of the lifting bracket 133, so that the stopper 135 is spaced from the upper part of the main body 63 and the projection 131, thereby allowing the rotation bracket 113 to return its original position.

With this configuration, the operations of the needle threading machine 1 of the sewing machine according to an embodiment of the present invention will be described with reference to accompanying drawings.

For reference, the needle threading section includes a threading aligning position in which the needle 11 is lifted up by a predetermined height beyond a predetermined sewing work section and thus the eye 11*a* of the needle 11 and the hook 53 are aligned with each other to put the thread 3 through the eye 11*a* of the needle 11, and a threading work position in which the needle bar bush 23 is further lifted up from the threading aligning position by a predetermined height and thus the eye 11*a* of the needle 11 is threaded with the thread 3.

The needle 11 of the sewing machine reciprocates within a predetermined sewing work section, i.e., between a top dead point and a bottom dead point, penetrating the needle plate.

When the thread 3 threaded through the eye 11*a* of the needle 11 of the sewing machine is replaced, the needle 11 is lifted up to a predetermined height beyond the top dead point of the sewing work section, i.e. lifted up to the threading aligning position of the needle threading section.

That is, in the state that the needle 11 is placed in the top dead point of the sewing work section, the cylinder rod 45 of the lifting driver 41 is extended and the connecting link 33 is lifted up so that the eye 11*a* of the needle 11 is placed on the same plane as the hook 53 of the thread catcher 51, thereby lifting up the needle bar bush 23.

As the needle bar bush 23 is lifted up, the needle bar 15 is also lifted up by the needle bar elastic member 31. At this time, the clutch releases the connection between the needle bar 15 and the needle bar driver, so that there is no trouble with the needle bar driver even though the needle bar 15 is lifted up.

Figure 3A:
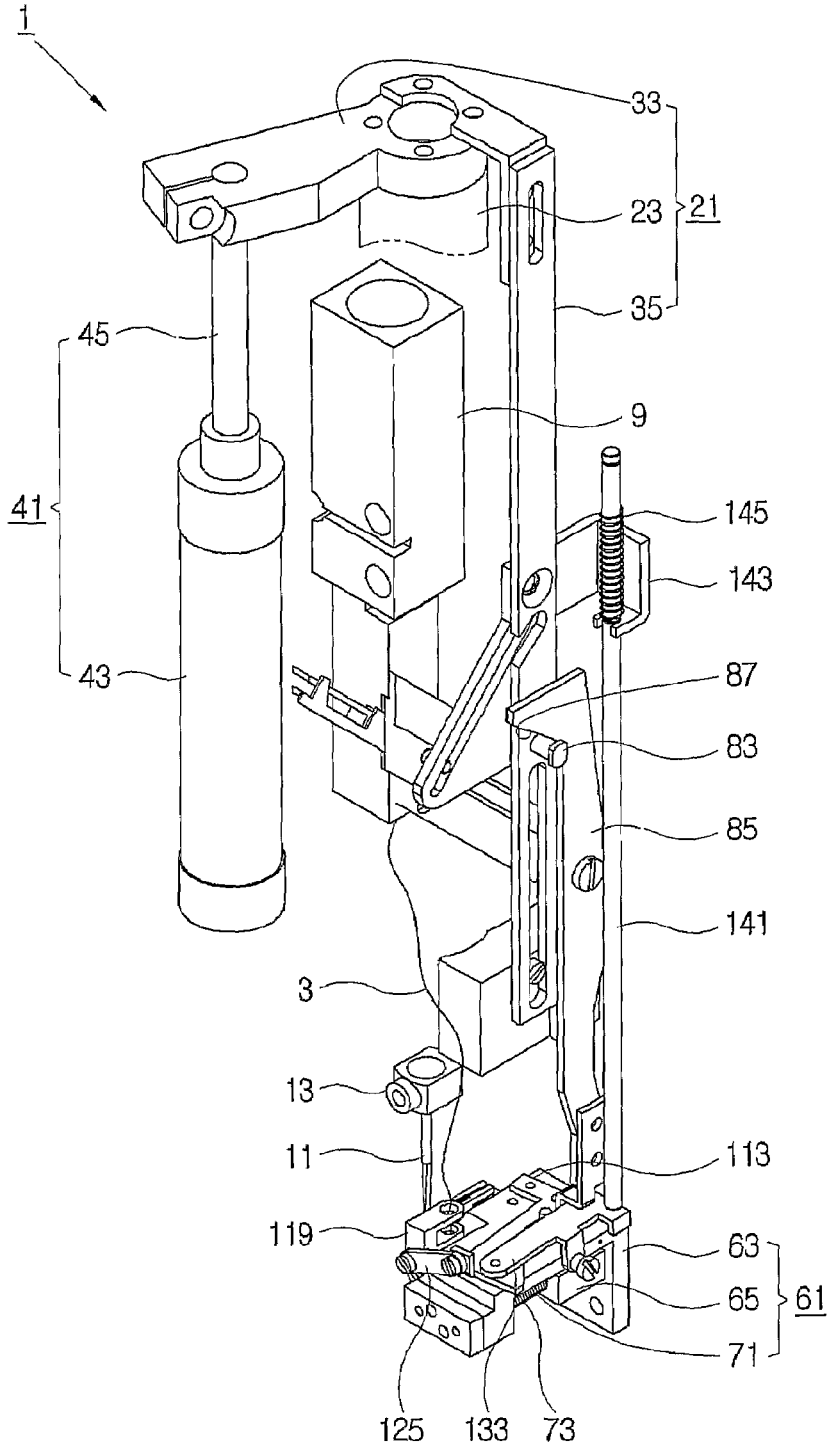
FIGS. 3A through 6B are perspective views and partially enlarged perspective views sequentially illustrating a needle threading operation of the needle threading machine of FIG. 1.
Figure 3B:
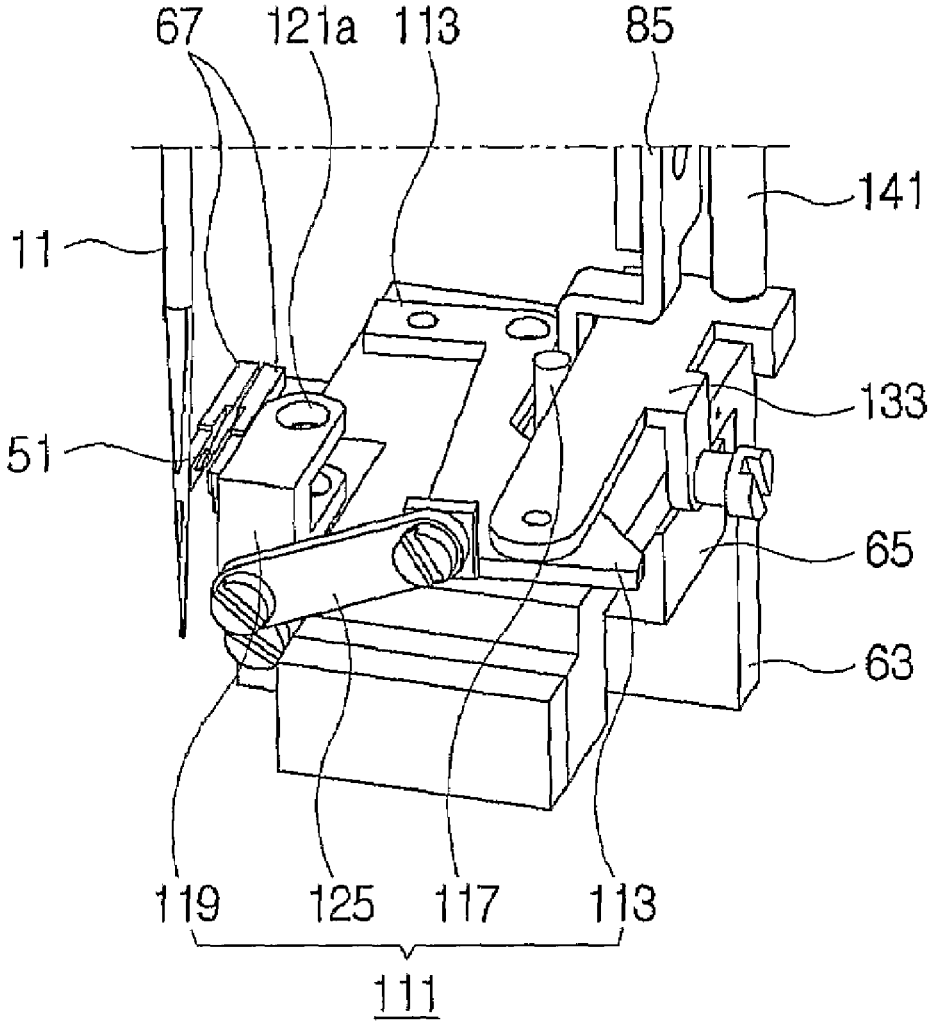

As the needle bar 15 is lifted up, the needle 11 is lifted up to a predetermined height beyond the top dead point of the sewing work section, so that the eye 11*a* of the needle 11 is placed on the same plane as the hook 53 of the thread catcher 51. That is, as shown in FIGS. 3A and 3B, the needle 11 is disposed in the threading aligning position to align the eye 11*a* with the hook 53.

After the needle 11 is lifted up to the threading aligning position, the thread supplying unit 9 supplies the thread 3 to the thread guiding bracket 119. At this time, the thread 3 penetrates the thread through hole 121*a* of the thread guiding bracket 119 toward the needle plate. Here, the thread 3 is transported from the thread supplying unit 9 to the thread guiding bracket 119 by compressed air along the inside of a thread guiding pipe (not shown) having a tube-like body and moving close to and away from the thread guiding bracket 119, thereby penetrating the thread through hole 121*a* of the thread guiding bracket 119.

Figure 4A:
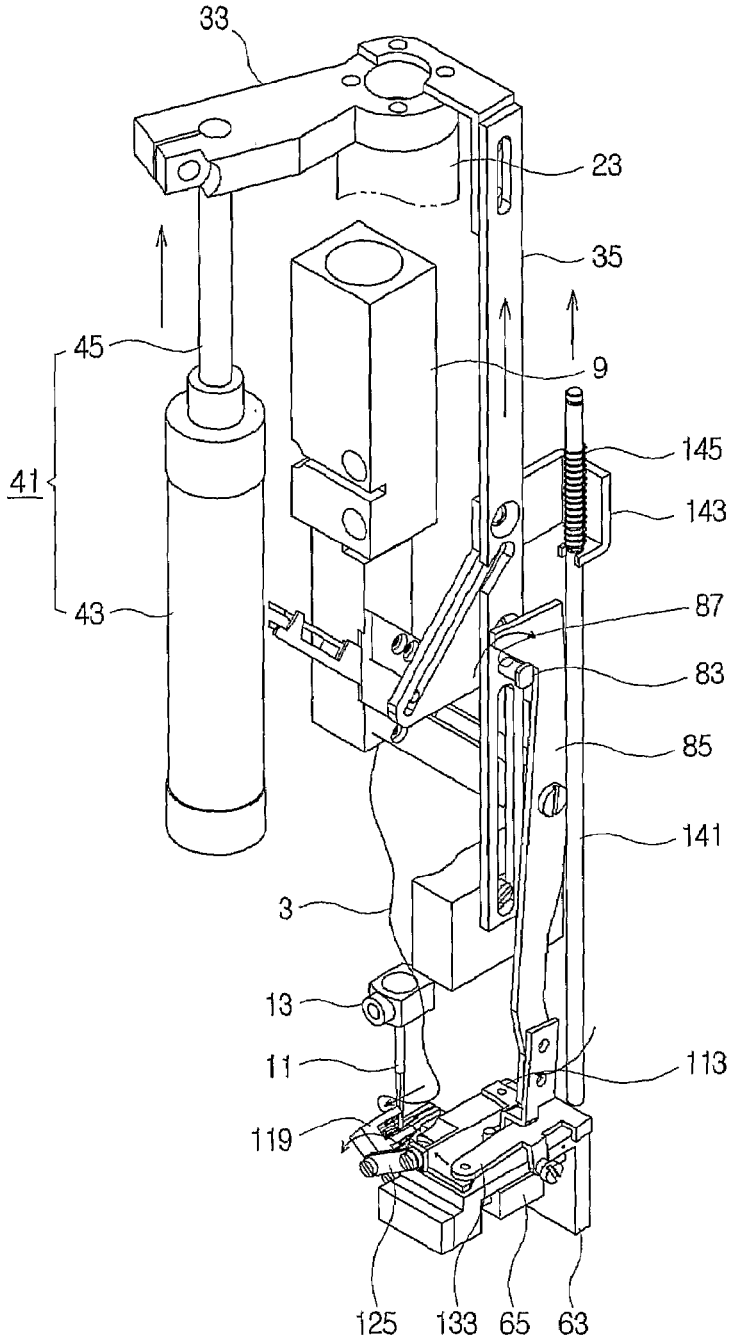
Figure 4B:
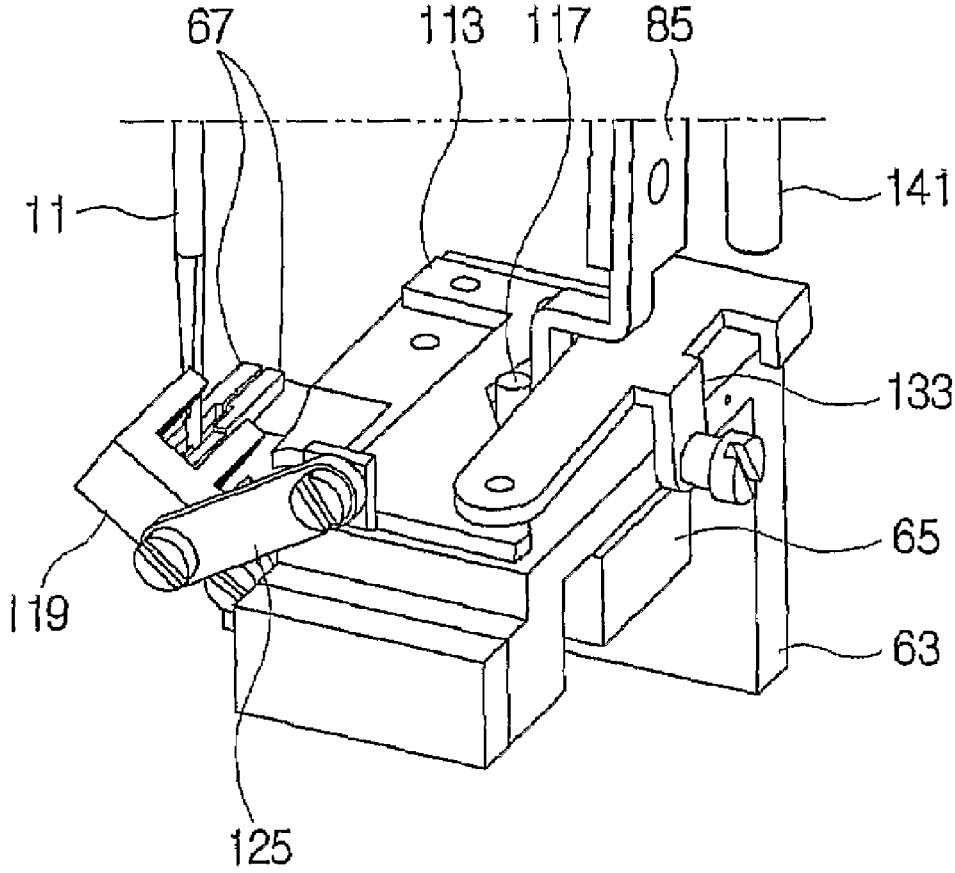
Figure 5A:
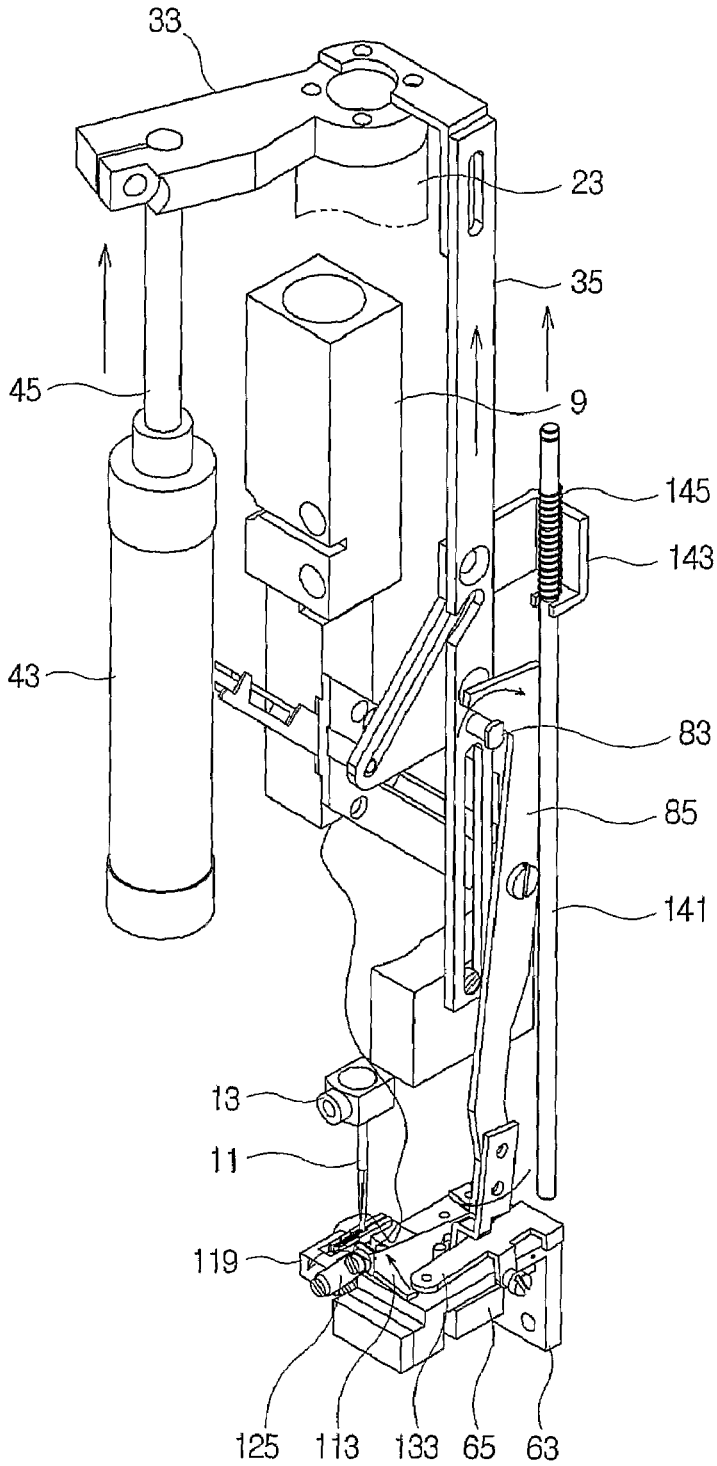
Figure 5B:
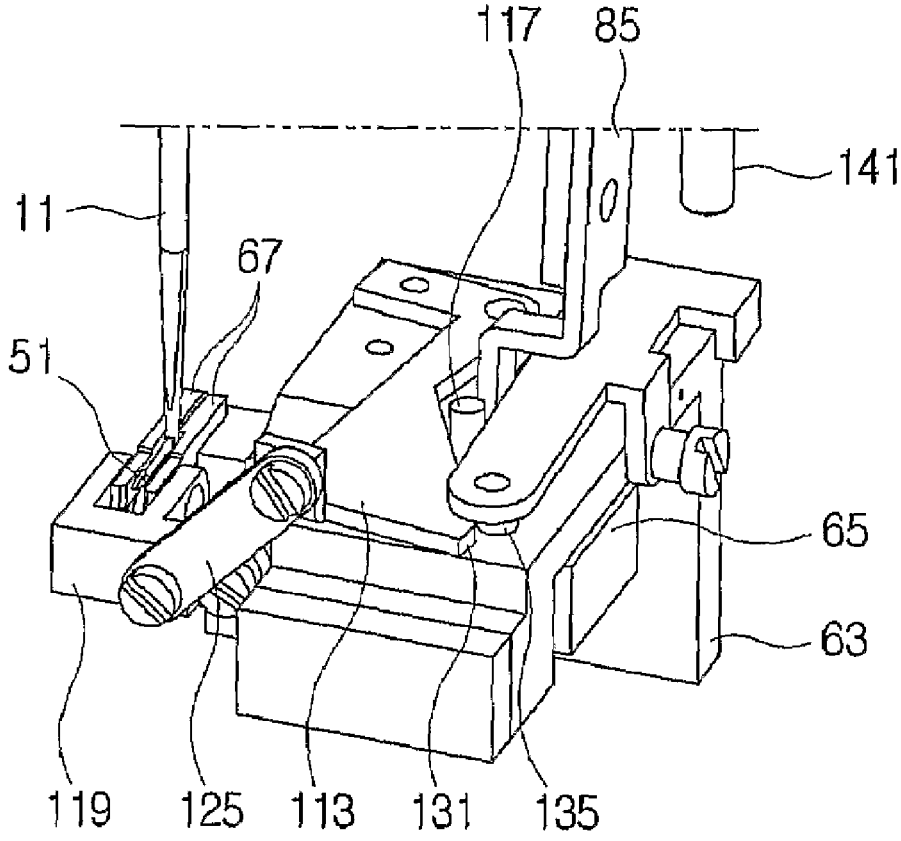

After the thread 3 penetrates the thread through hole 121*a* of the thread guiding bracket 119, the needle bar bush 23 is lifted up to a predetermined height, i.e. to the threading work position. At this time, only the needle bar bush 23 is lifted up to the threading work position while the needle 11 and the needle bar 15 are maintained in the threading aligning position. As shown in FIGS. 4A and 4B, when the needle bar bush 23 is lifted up to the threading work position, the driving pin 83 protruding from the first side of the lifting bar 35 contacts and moves up along the reciprocating profile 87 provided in the driving link 85, and thus the lower part of the driving link 85 is rotated from the back to the front of the main body 63 and accommodated in the link accommodating groove 69, thereby pressing the thread catcher supporter 65. At the same time, the lifting rod 141 pressing the lifting bracket 133 is also lifted up, so that the lifting bracket 133 is released from the pressure of the lifting rod 131.

As the thread catcher supporter 65 is pressed, the thread catcher supporter 65 moves from the back to the front of the main body 63, and thus the hook 53 of the thread catcher 51 placed on the same plane as the eye 11*a* of the needle 11 moves toward the eye 11*a* of the needle 11 and passes through the eye 11*a* of the needle 11.

Further, as the thread catcher supporter 65 moves from the back to the front of the main body 63, the rotation pin 17 provided in the upper part of the thread catcher supporter 65 moves frontward along the slot of the main body 63 and thus contacts and moves along the thread guiding profile 115 formed in the rotation bracket 113, thereby rotating the rotation bracket 113 in a first direction. At the same time, the stopper 135 provided in the lifting bracket 133 closely contacts the projection 131 formed in the rotation bracket 113, so that the rotation bracket 113 is not rotated any more.

As the rotation bracket 113 rotates, the auxiliary link 125 rotates. Therefore, the thread guiding bracket 119 is rotated at an angle of about 90 degree, thereby guiding the thread 3 passing through the thread through hole 121*a* of the thread guiding bracket 119 to the plane formed by the eye 11*a* of the needle 11 and the hook 53, and at the same time, taking up the thread 3 on the thread catcher 51. At this time, the thread catcher 51 and the hook guide 67 are positioned between the pair of thread guides 121 of the thread guiding bracket 119.

Figure 6A:
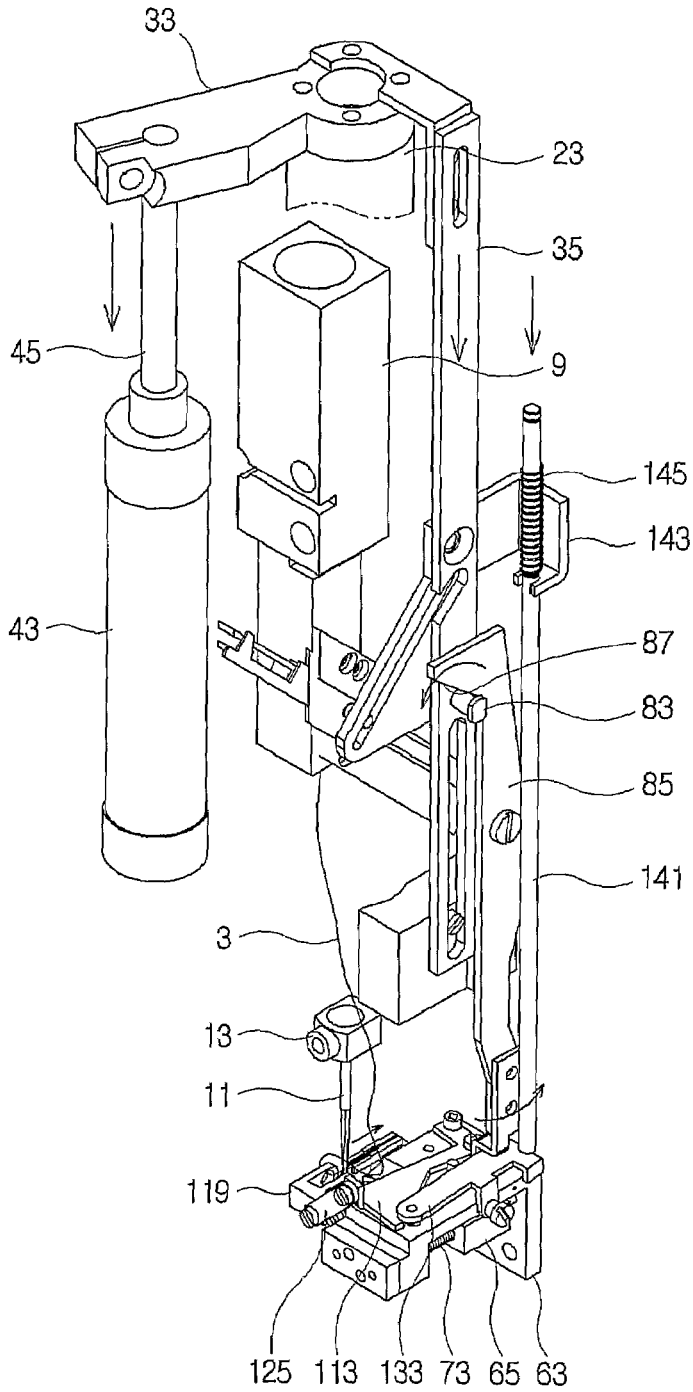
Figure 6B:
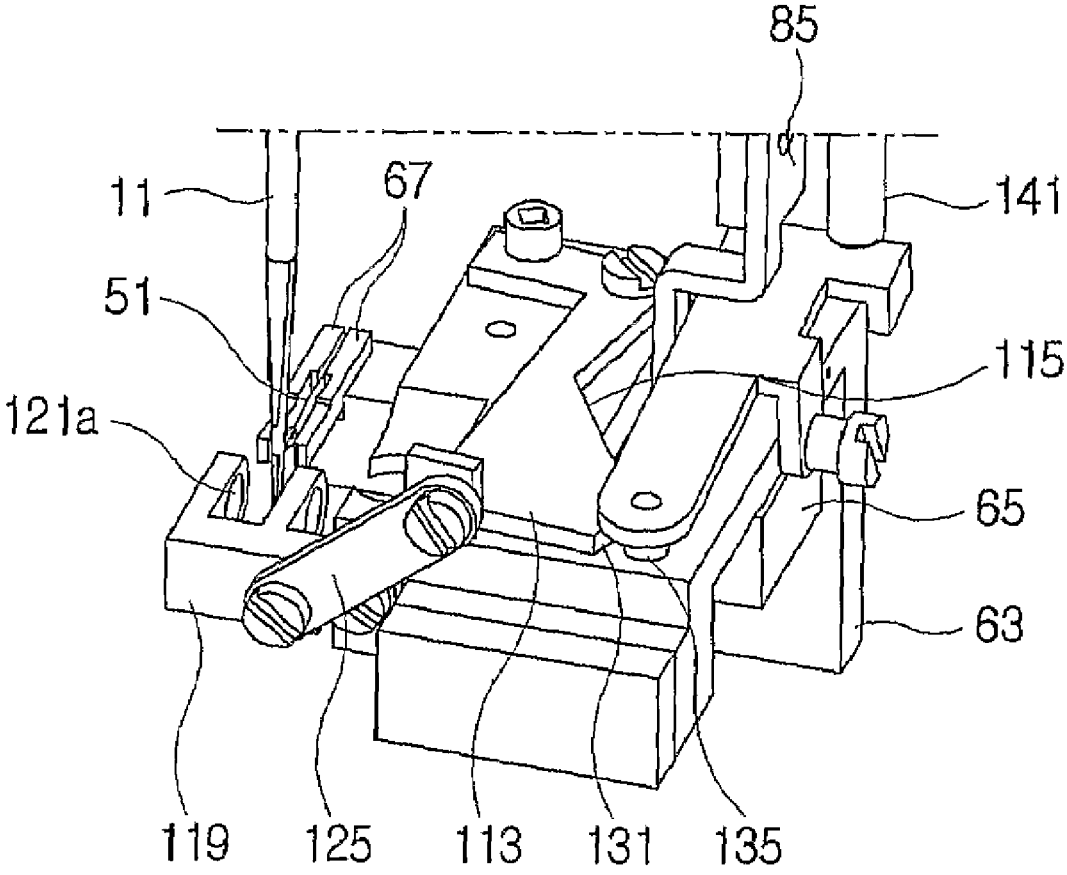
Figure 7:
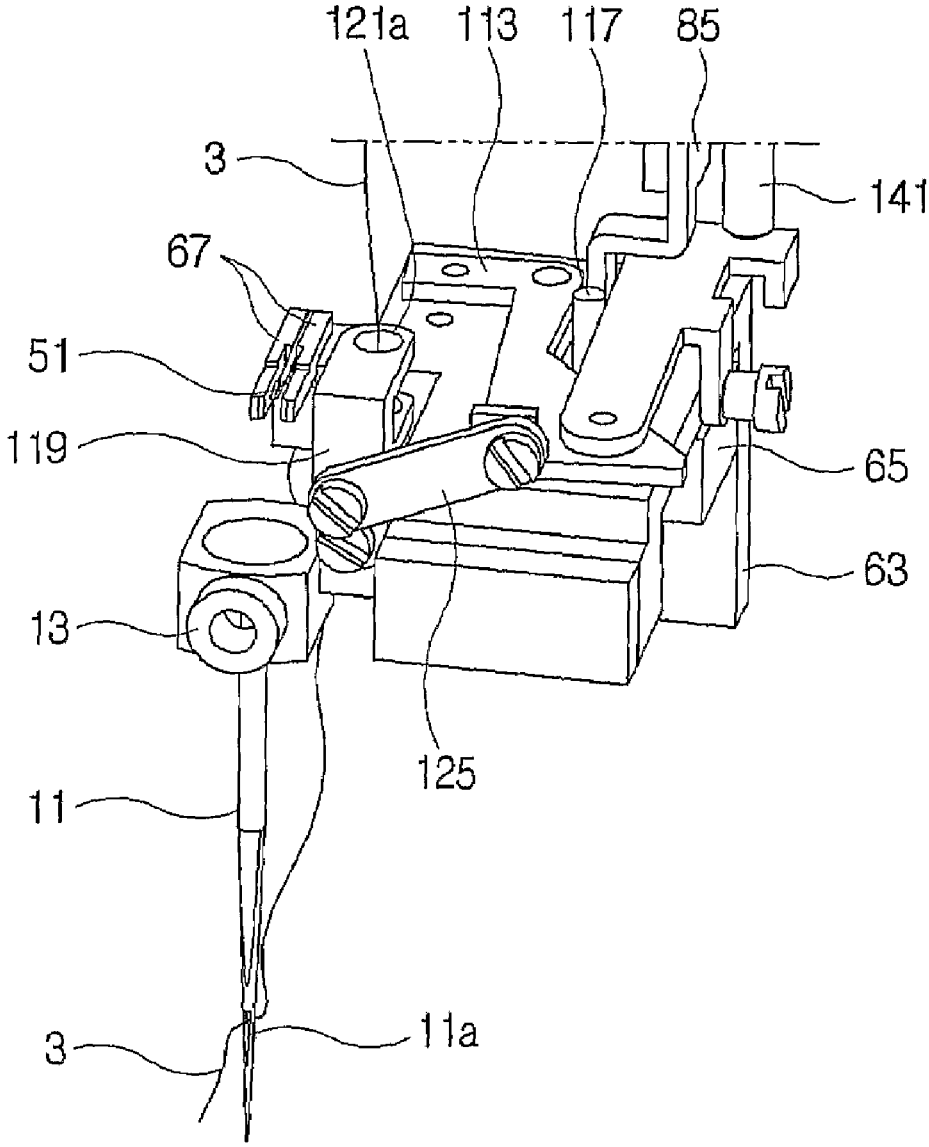
FIG. 7 is a partially enlarged perspective view of the needle threading machine of FIG. 1 in the state that the needle threading operation thereof is completed.

Then, as shown in FIGS. 6A and 6B, the needle bar bush 23 in the threading work position is driven by the lifting driver 41 to be lifted down again to the threading aligning position. As the needle bar bush 23 is lifted down, the lifting rod 141 spaced from the lifting bracket 133 is also lifted down.

As the needle bar bush 23 is lifted down, the driving pin 83 protruding from the first side of the lifting bar 35 contacts and moves along the reciprocating profile 87 provided in the driving link 85. Therefore, the lower part of the driving link 85 is rotated toward the back of the main body 63, so that the thread catcher supporter 65 is released from the pressure of the lower part of the driving link 85.

When the thread catcher supporter 65 is released from the pressure of the lower part of the driving link 85, the thread catcher supporter 65 moves toward the back of the main body 63 by the elasticity of the supporting shaft elastic member 73, and thus the thread catcher 51 supported by the thread catcher supporter 65 also moves toward the back of the main body 63. Therefore, the hook 53 of the thread catcher 51 gets out of the eye 11*a* of the needle 11 while holding the thread 3, i.e., returns back from the eye 11*a* of the needle 11, thereby being spaced from the needle 11 at a predetermined distance. At this time, the thread 3 passes through the eye 11*a* of the needle 11 and maintained to be held in the hook 53 of the thread catcher 51.

Then, when the lifting driver 41 drives the needle bar bush 23 to be lifted down so that the needle 11 moves from the threading work section to the sewing work section, the needle bar bush 23 is lifted down, and at the same time the needle 11 and the needle bar 15 are lifted down. At the same time, the lifting rod 41 is also lifted down and presses the first side of the lifting bracket 133, so that the stopper 135 of the lifting bracket 133 is spaced from the top surface of the main body 63 and released from the projection 131 of the rotation bracket 113, thereby allowing the rotation bracket 113 to rotate in a second direction and return to its original position. As the rotation bracket 113 is rotated and returns to its original position, the auxiliary link 125 is rotated in the second direction, so that the thread guiding bracket 119 also returns to its original position.

Figure 9A:
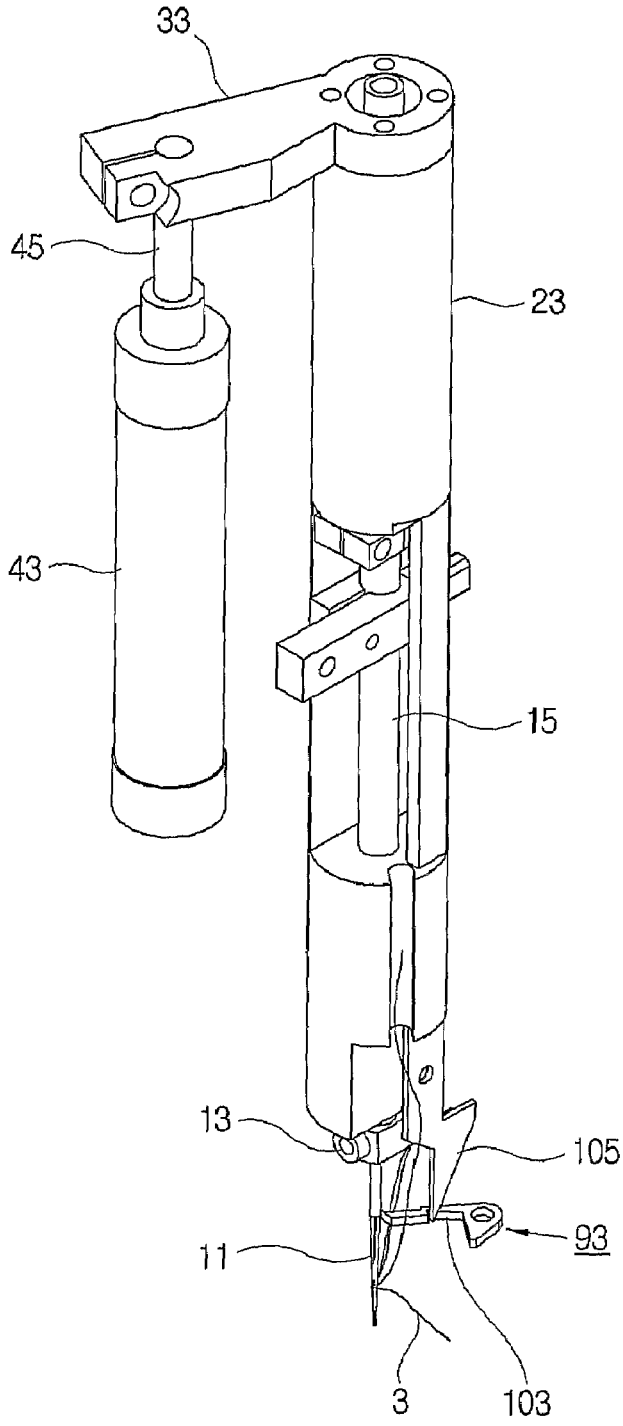
FIGS. 9A through 9C are a partially enlarged perspective view, a bottom view and a partial lateral view illustrating an operation of the thread transporting unit.
Figure 9B:
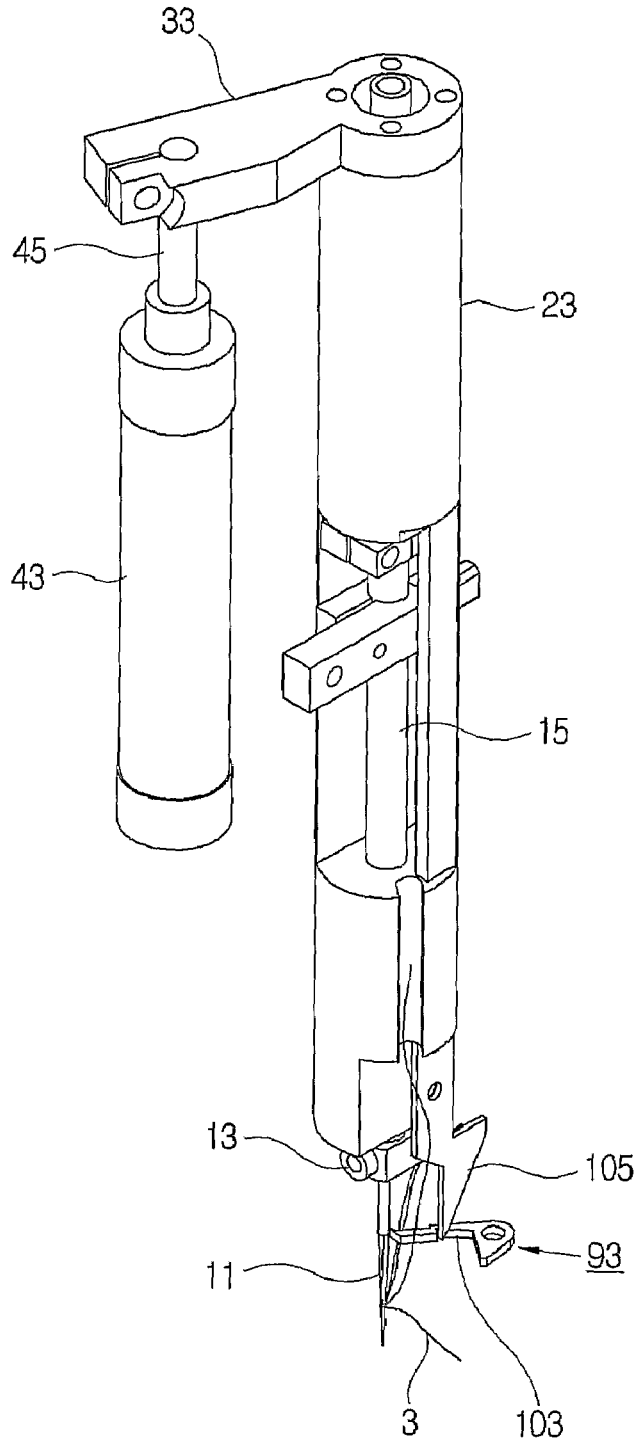
Figure 9C:
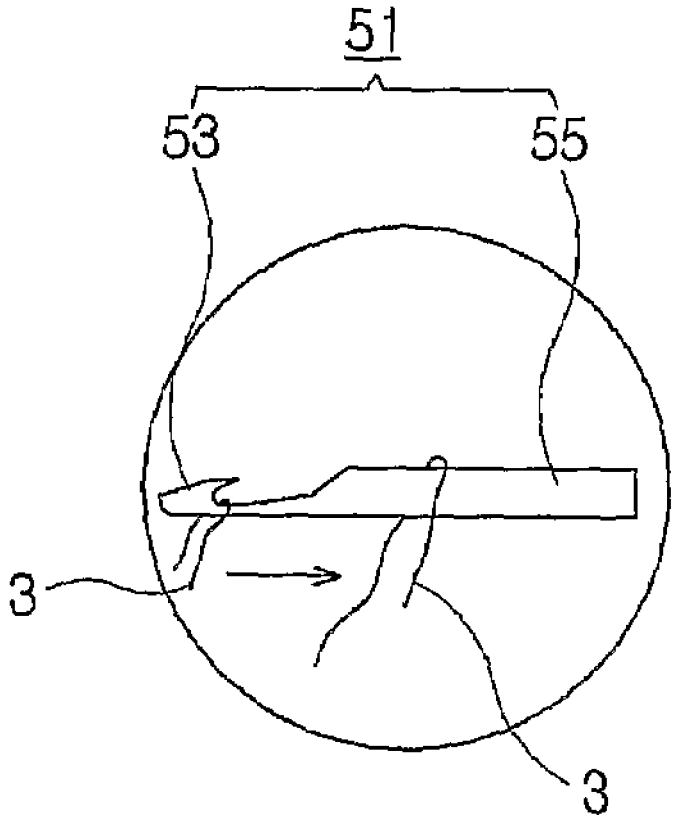
Figure 10:
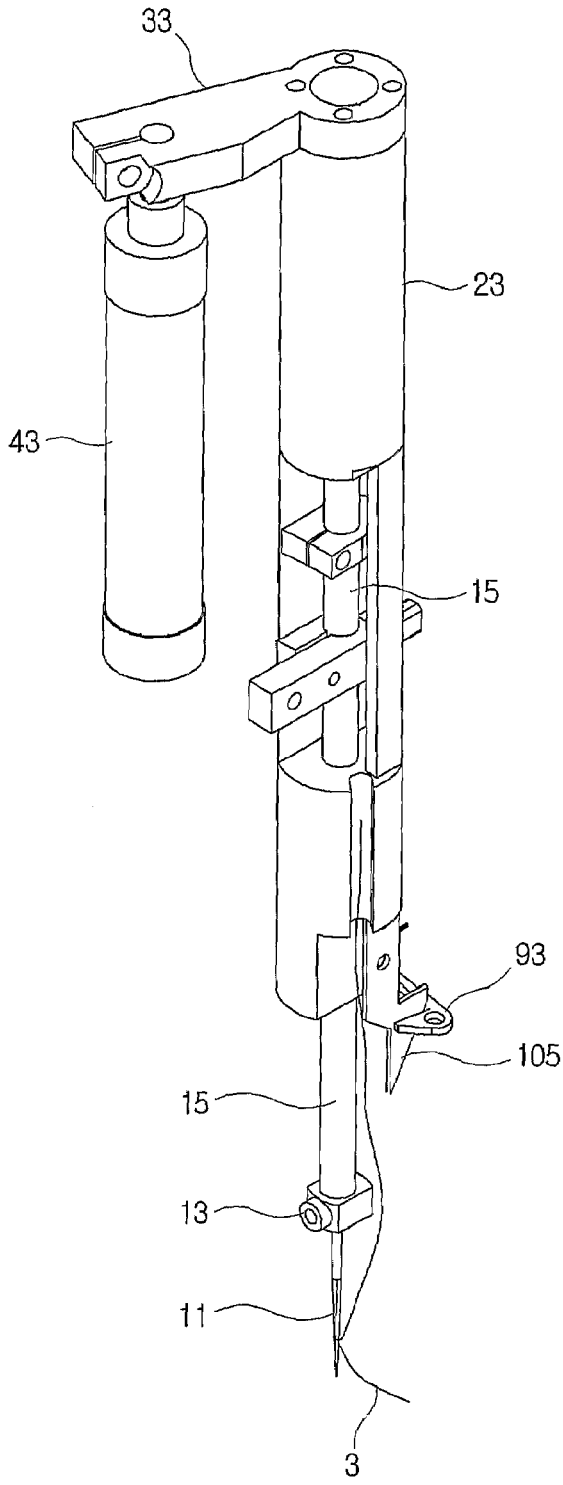
FIG. 10 is a perspective view of the thread transporting unit in the state that the operation thereof is completed.

As shown in FIGS. 9A and 9B, the thread releasing bracket 105 provided in the needle bar bush 23 and spaced from the thread transporting bracket 93 (refer to FIGS. 8A and 8B) contacts and moves down along the thread transporting profile 103 formed in the thread transporting bracket 93 as the needle bar 15 and the needle bar bush 23 are lifted down, thereby rotating the thread transporting bracket 93 in a first direction. At this time, as shown in FIG. 9C, the thread taking-up unit 95 of the thread transporting bracket 93 passes through the eye 11*a* of the needle 11 and takes up the thread draped on the hook supporter 55, thereby transporting the thread 3 along the hook supporter 55 to move far away from the hook 53.

As the needle bar 15 and the needle bar bush 23 are lifted down from the needle threading section to the sewing work section, the thread 6 draped on the hook supporter 55 of the thread catcher 51 is released from the hook supporter 55 and remained in the eye 11*a* of the needle 11, thereby completing the needle threading work as shown in FIGS. 7 through 10.

Figure 11:
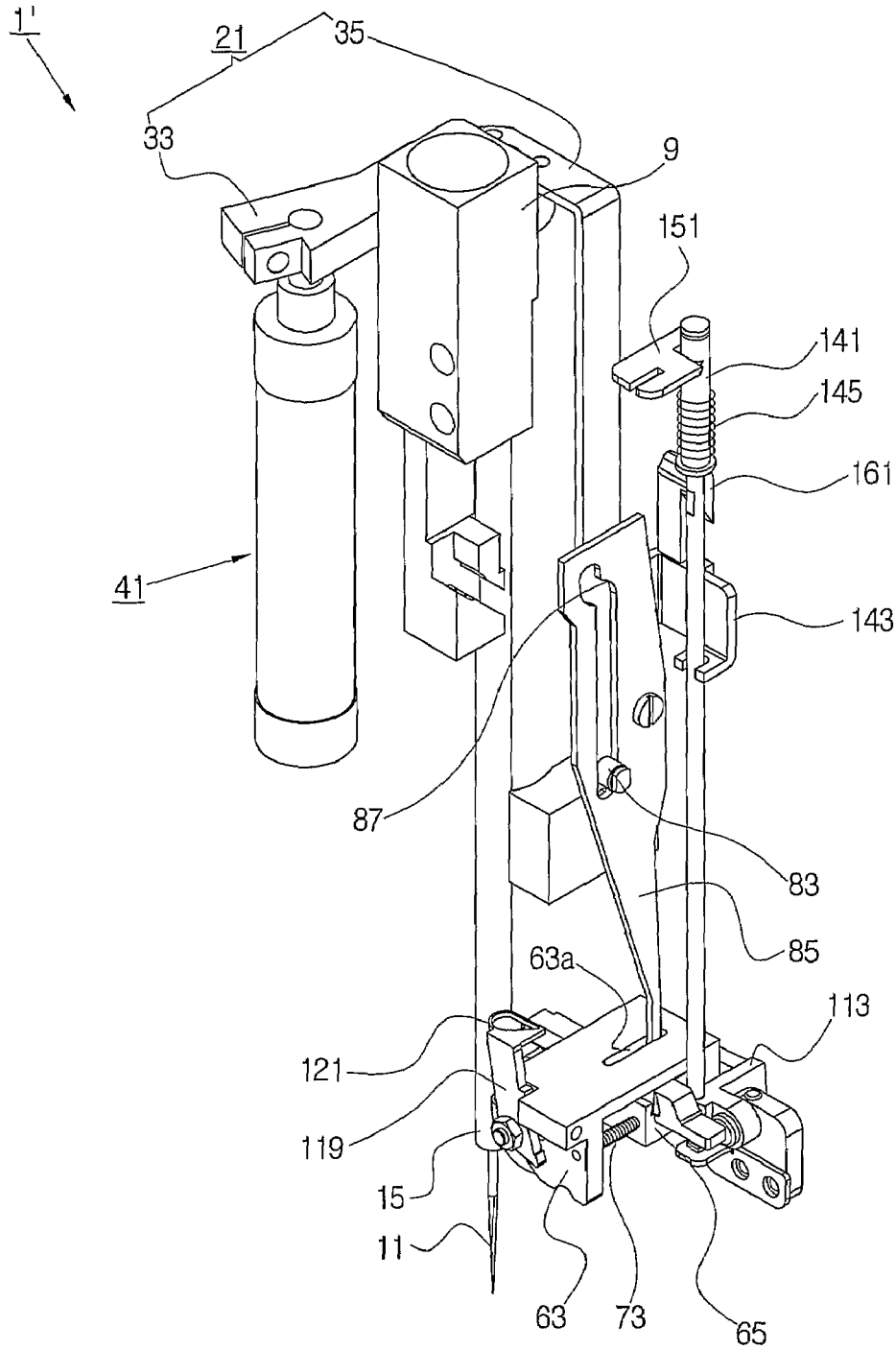
FIG. 11 is a perspective view of a needle threading machine according to a second embodiment of the present invention.
Figure 12A:
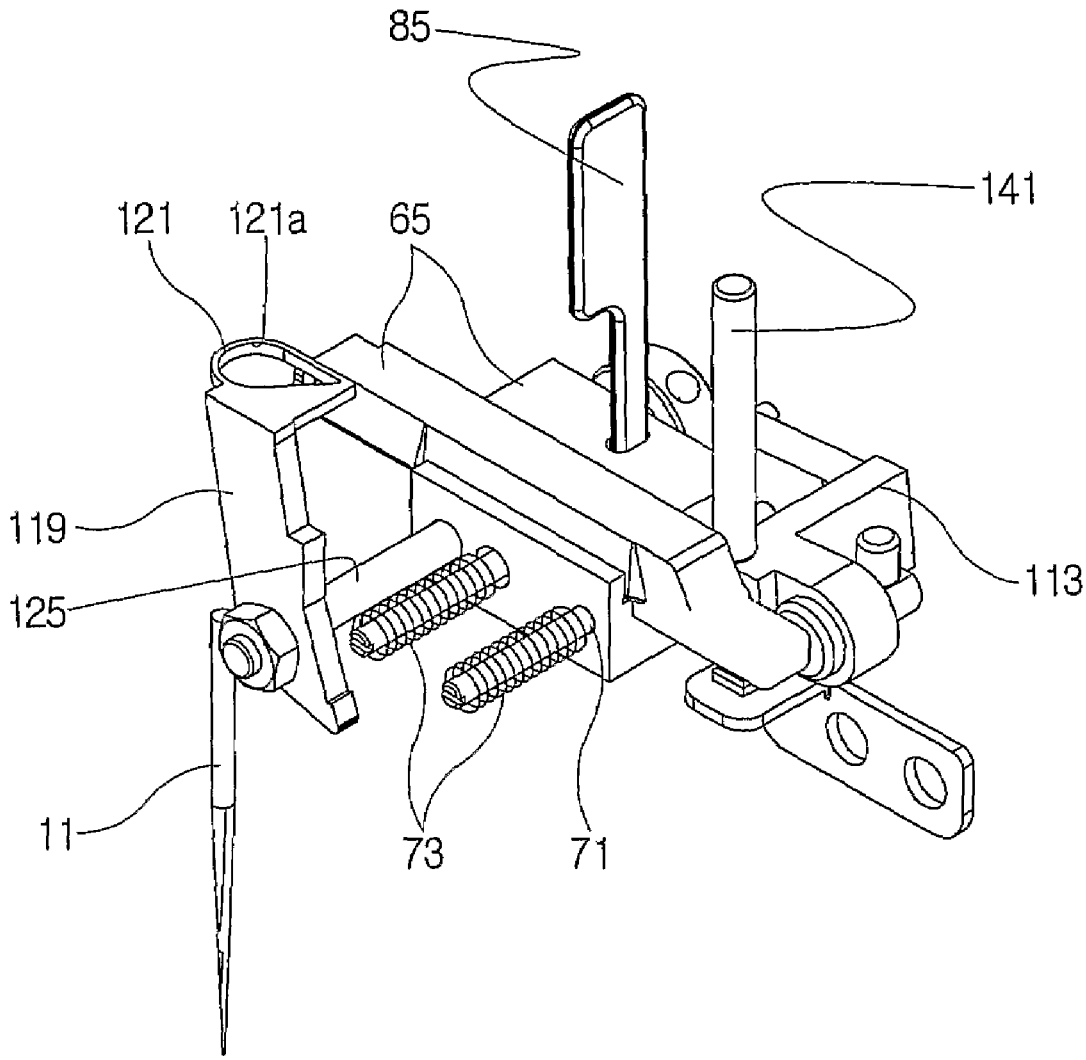
FIG. 12A is a partially enlarged perspective view illustrating a state that a main body is removed.
Figure 12B:
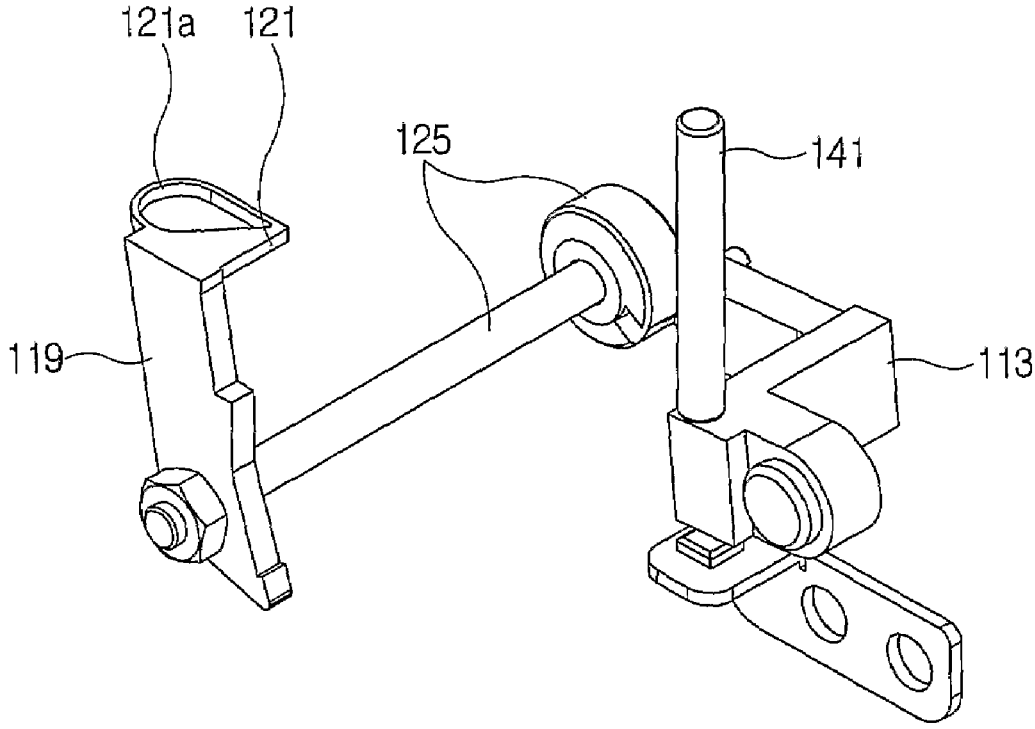
FIG. 12B is a partially enlarged perspective view illustrating an assembled structure of a rotation bracket and a thread guiding bracket.

In the meantime, FIGS. 11, 12A and 12B illustrate a needle threading machine according to a second embodiment of the present invention. Contrary to the first embodiment, a needle threading machine 1' according to the second embodiment of the present invention includes the rotation bracket 113 rotatably coupled to the main body 63; the thread guiding bracket 119 to guide the thread 3 supplied from the thread supplying unit 9 to be taken up and hooked on the hook 53; an auxiliary link 125 connecting the rotation bracket 113 with the thread guiding bracket 119 and transferring rotation of the rotation bracket 113 to the thread guiding bracket 119; and a rotation bracket elastic member 171 provided between the main body 63 and the rotation bracket 113 and elastically urging the rotation bracket 113 to rotate, thereby allowing the thread 3 taken up in the thread guiding bracket 119 to be caught in the hook 53

Further, the needle threading machine 1' according to the second embodiment of the present invention includes the lifting rod 141 formed with a groove 141*a* at an upper part thereof.

The lifting rod 141 is provided with a lifting clutch 151, so that the lifting operation of the lifting rod 141 is controlled. The lifting clutch 151 includes a protrusion 153 locked to and released from the groove 141*a*, and an extended part 155 extended from the protrusion 153. Also, the lifting clutch 151 is coupled to the supporting frame 5 by a clutch elastic member (not shown), so that the lifting clutch 151 reciprocates transversely to the lifting direction of the lifting rod 141.

The upper part of the auxiliary bracket 143 is provided with a clutch operator 161 to operate the lifting clutch 151. The clutch operator 161 is formed with a clutch cam profile 163 inclined downward so that the extended part 155 moves being in contact with and spaced from the clutch cam profile 163. When the lifting rod 141 is lifted down, the extended part 155 moves being in contact with the clutch cam profile 163 of the clutch operator 161, so that the protrusion 153 of the lifting clutch 151 is released from the groove 141*a* of the lifting rod 141.

Therefore, the thread 3 caught in the hook 53 passes through the eye 11*a* of the needle 11, and the thread guiding bracket 119 is returned to its original position. That is, the hook 53 and the thread guiding bracket 119 are operated leaving a time lag, so that the thread 3 is safely hooked in the hook 53.

In the needle threading machine 1' with this configuration according to the second embodiment of the present invention, a process of hooking the thread 3 on the hook 53 is as follows.

Figure 13A:
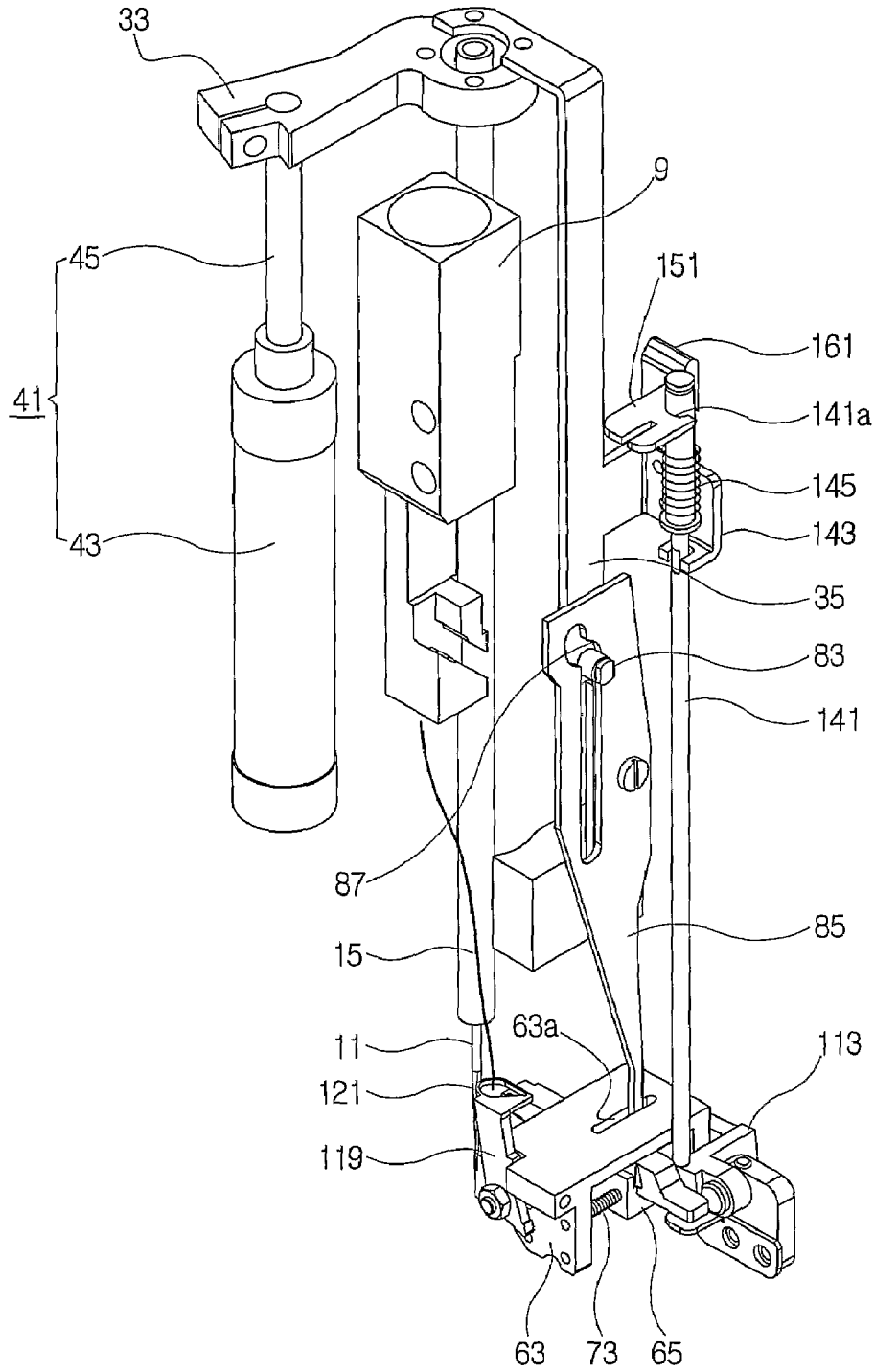
FIGS. 13 through 15 are perspective views and partially enlarged perspective views sequentially illustrating a needle threading operation of the needle threading machine of FIG. 11.
Figure 13B:
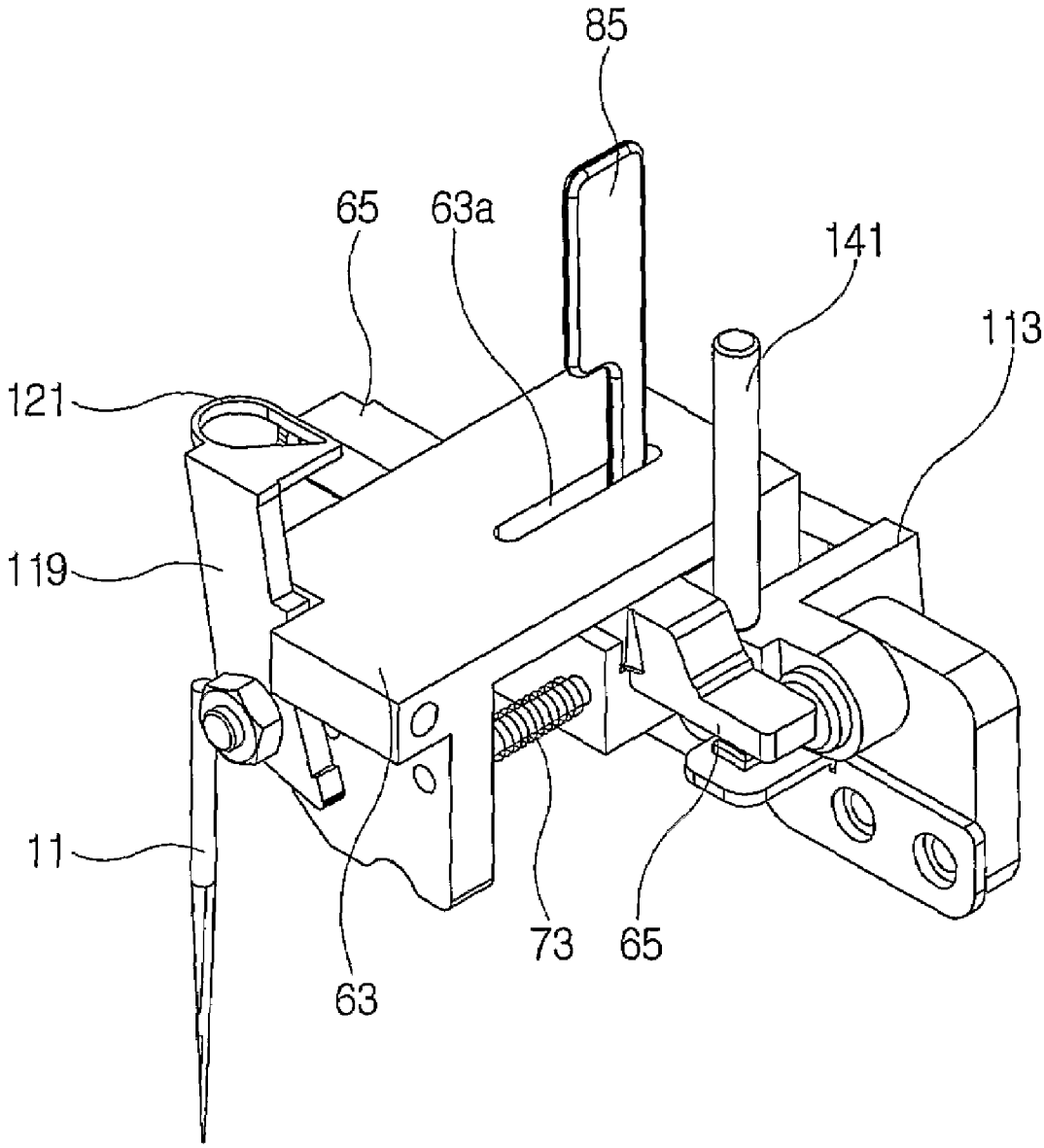
Figure 13C:
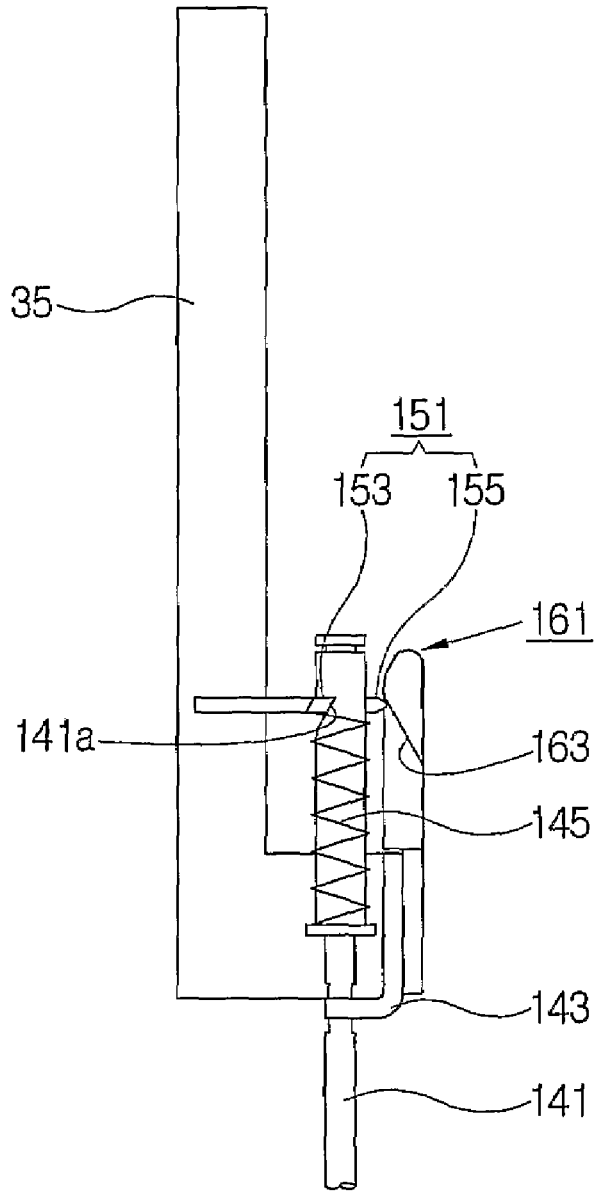

As shown in FIGS. 13A through 13C, when the eye 11*a* of the needle 11 is placed on the same plane as the hook 53 of the thread catcher 51, i.e., when the eye 11 of the needle 11 moves to the threading aligning position in which the eye 11*a* of the needle 11 and the hook 53 are aligned, the thread supplying unit 9 supplies the thread 3 to the thread guiding bracket 119. At this time, the thread 3 penetrates the thread through hole 121*a* of the thread guiding bracket 119 toward the needle plate.

Figure 14A:
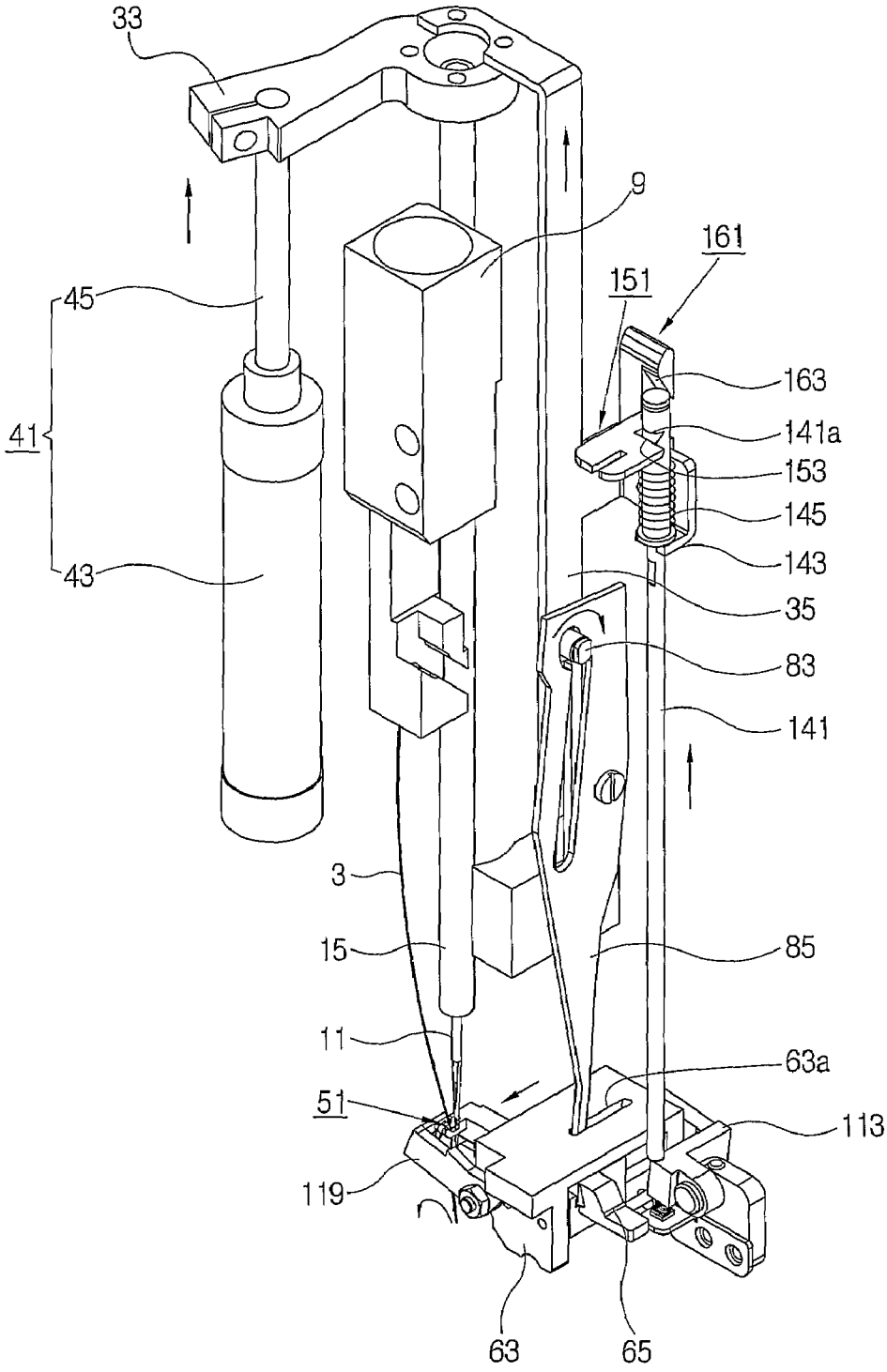
Figure 14B:
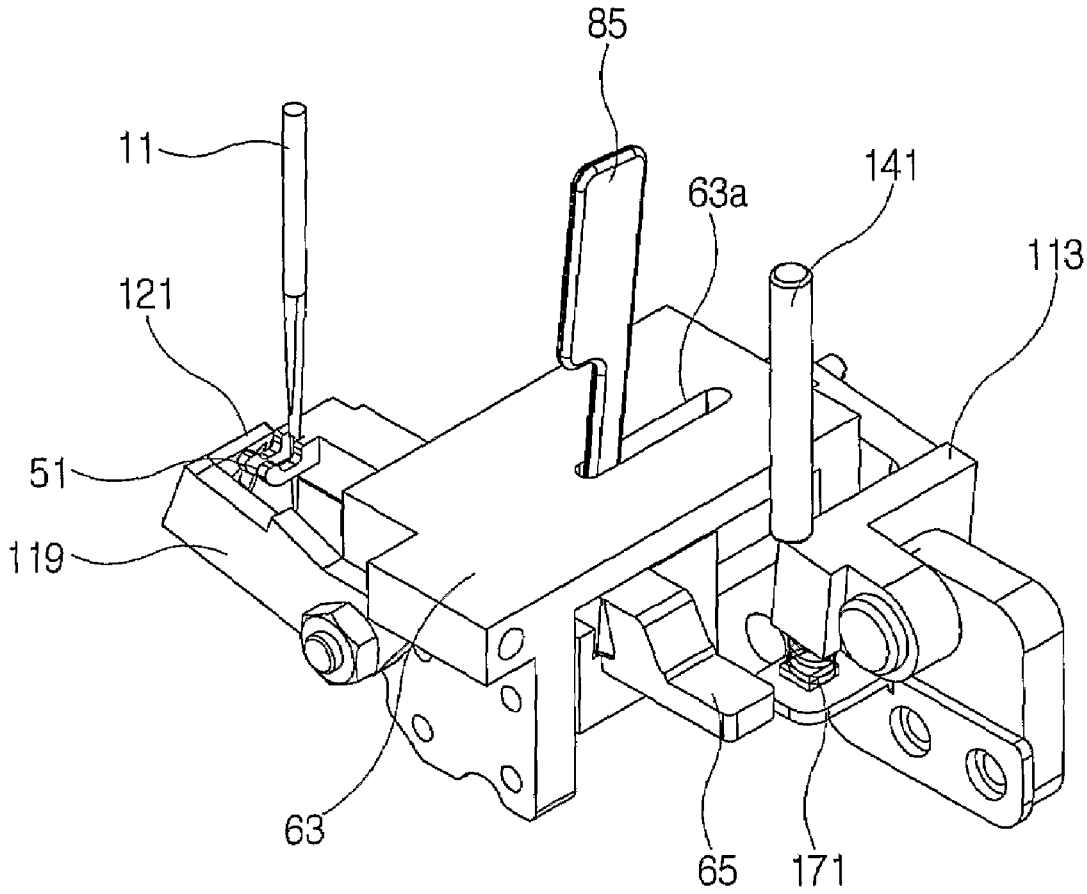
Figure 14C:
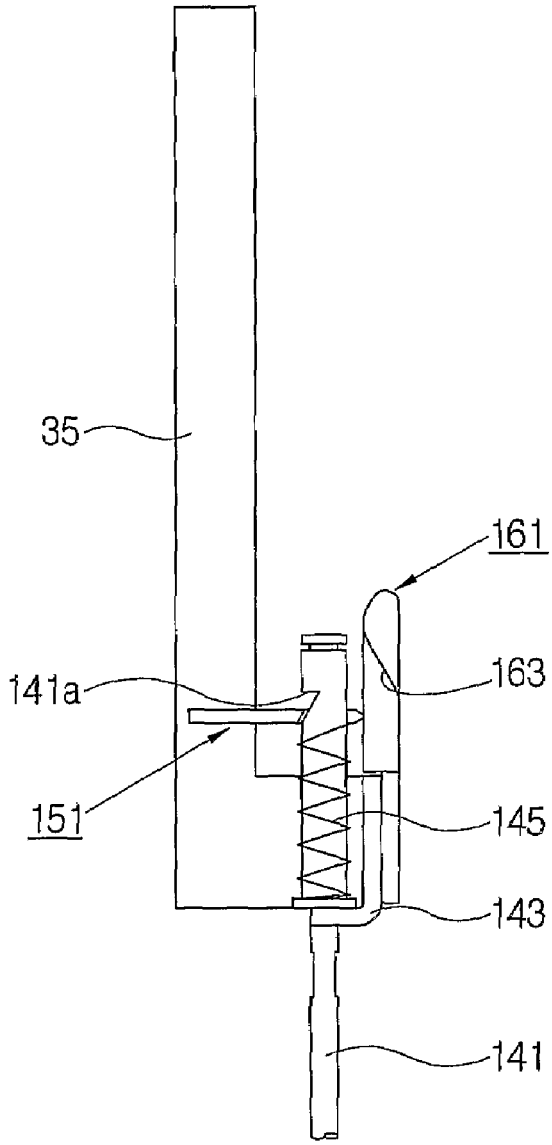

After the thread 3 penetrates the thread through hole 121*a* of the thread guiding bracket 119, the needle bar bush 23 is lifted up to a predetermined height, i.e. to the threading work position. At this time, only the needle bar bush 23 is lifted up to the threading work position while the needle 11 and the needle bar 15 are maintained in the threading aligning position. As shown in FIGS. 14A through 14C, when the needle bar bush 23 is lifted up to the threading work position, the driving pin 83 protruding from the first side of the lifting bar 35 contacts and moves up along the reciprocating profile 87 provided in the driving link 85, and thus the lower part of the driving link 85 is rotated from the back to the front of the main body 63 and accommodated in the link accommodating groove 69, thereby pressing the thread catcher supporter 65. At the same time, the lifting rod 141 pressing the lifting bracket 133 is also lifted up, so that the lifting bracket 133 is released from the pressure of the lifting rod 131.

As the thread catcher supporter 65 is pressed, the thread catcher supporter 65 moves from the back to the front of the main body 63, and thus the hook 53 of the thread catcher 51 placed on the same plane as the eye 11*a* of the needle 11 moves toward the eye 11*a* of the needle 11 and passes through the eye 11*a* of the needle 11.

Meanwhile, the lifting rod 141 pressing the top surface of the rotation bracket 113 is lifted up and spaced from the rotation bracket 113, so that the rotation bracket 113 are rotated by the elasticity of the rotation bracket elastic member 171.

Figure 14D:
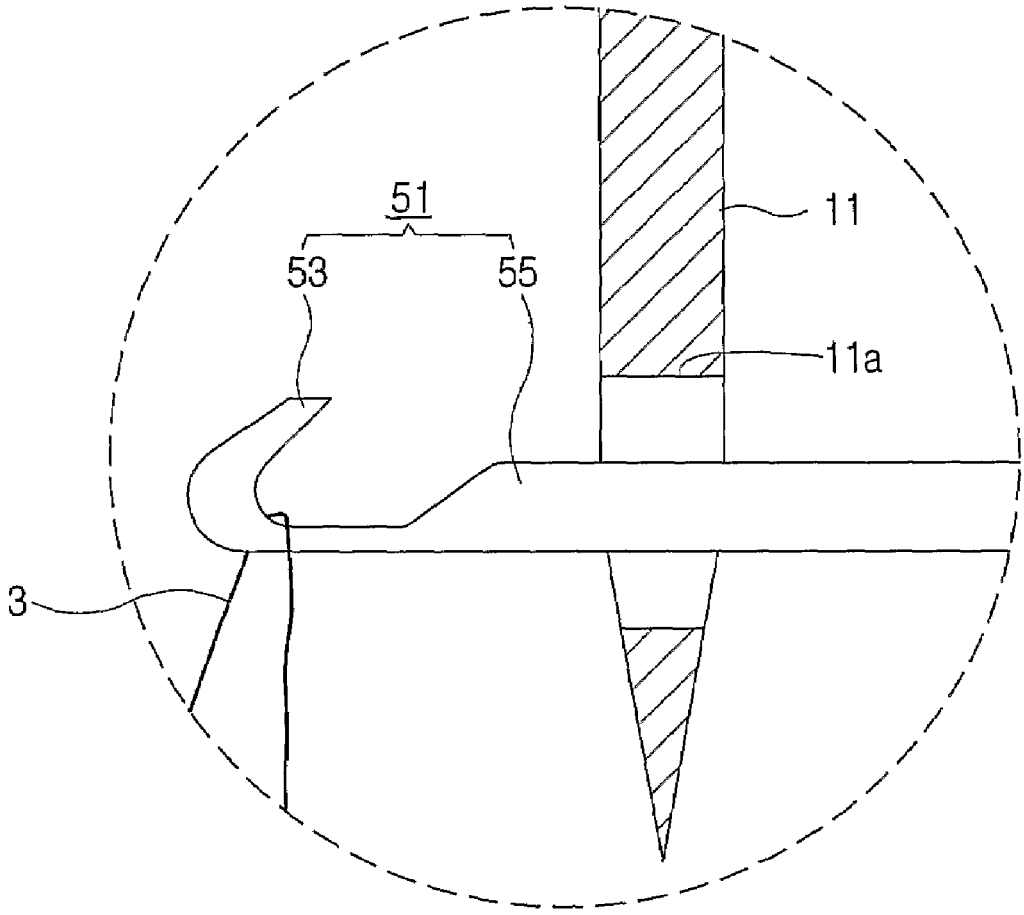

As the rotation bracket 113 rotates, the auxiliary link 125 rotates. Therefore, the thread guiding bracket 119 is rotated at an angle of about 90 degree, thereby guiding the thread 3 passing through the thread through hole 121*a* of the thread guiding bracket 119 to the plane formed by the eye 11*a* of the needle 11 and the hook 53, and at the same time, taking up the thread 3 on the thread catcher 51 as shown in FIG. 14D.

Figure 15A:
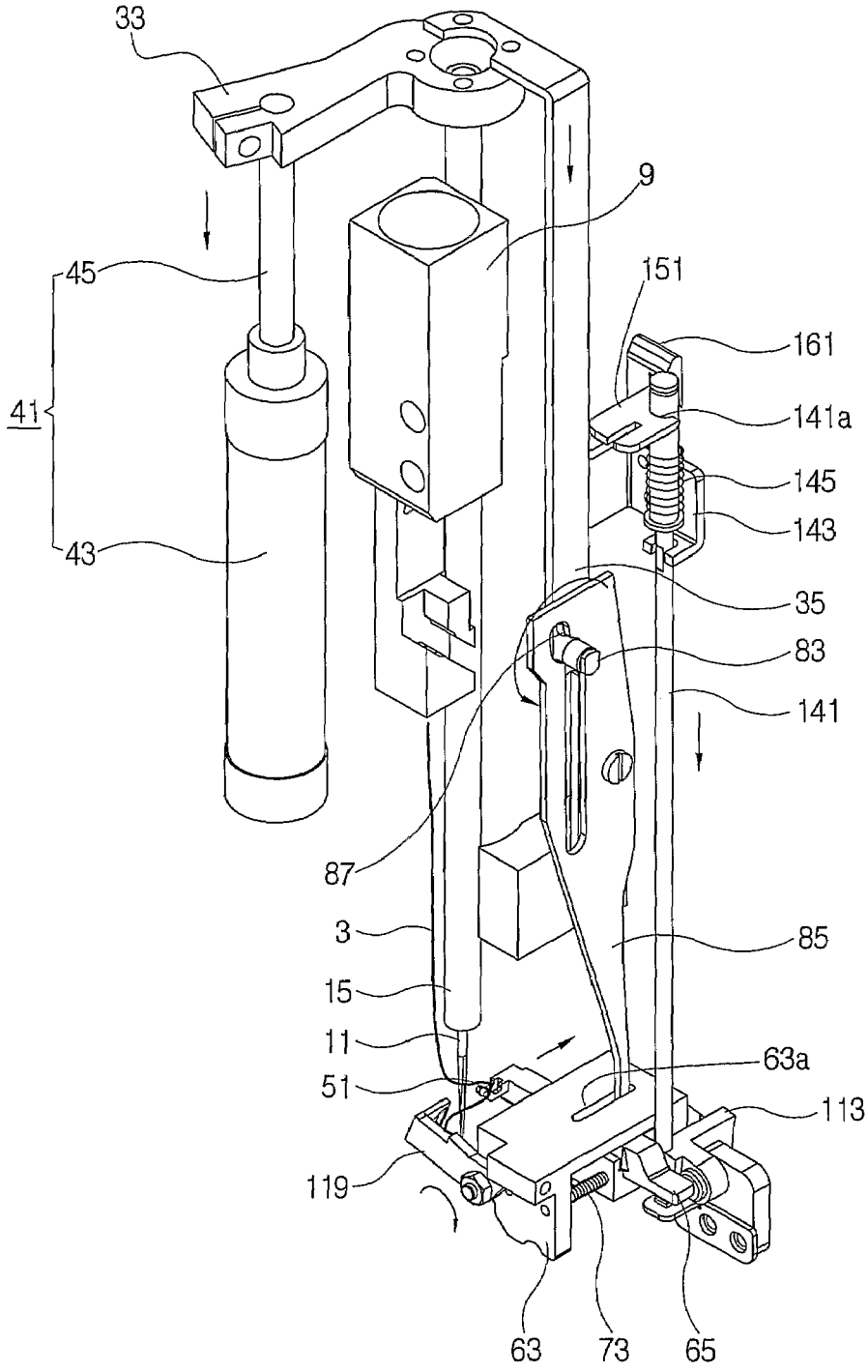
Figure 15B:
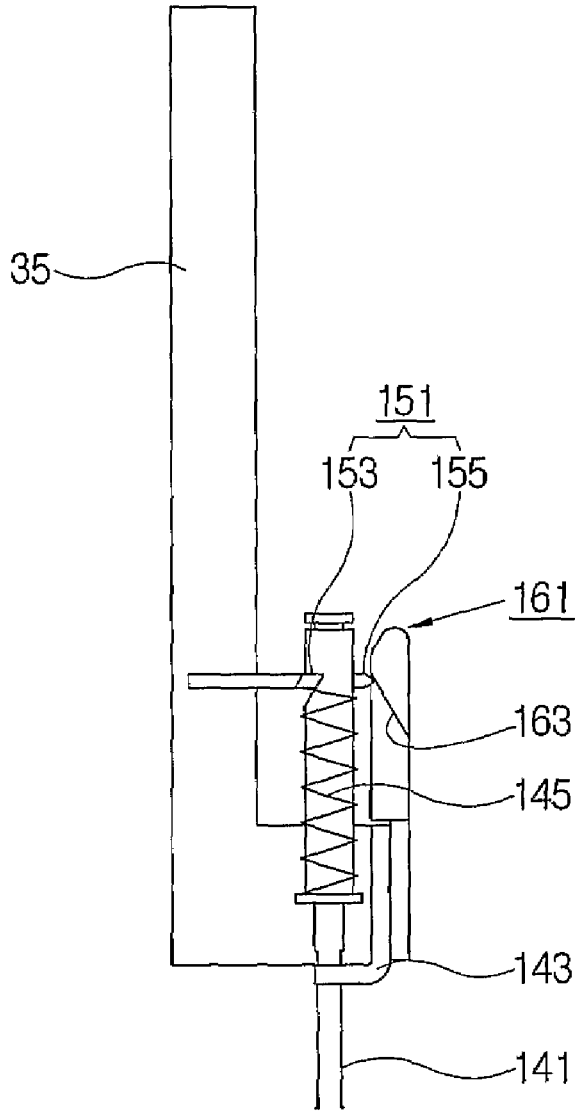

Then, as shown in FIGS. 15A and 15B, the needle bar bush 23 in the threading work position is driven by the lifting driver 41 to be lifted down again to the threading aligning position.

As the needle bar bush 23 is lifted down, the driving pin 83 protruding from the first side of the lifting bar 35 contacts and moves along the reciprocating profile 87 provided in the driving link 85. Therefore, the lower part of the driving link 85 is rotated toward the back of the main body 63, so that the thread catcher supporter 65 is released from the pressure of the lower part of the driving link 85.

Figure 15C:
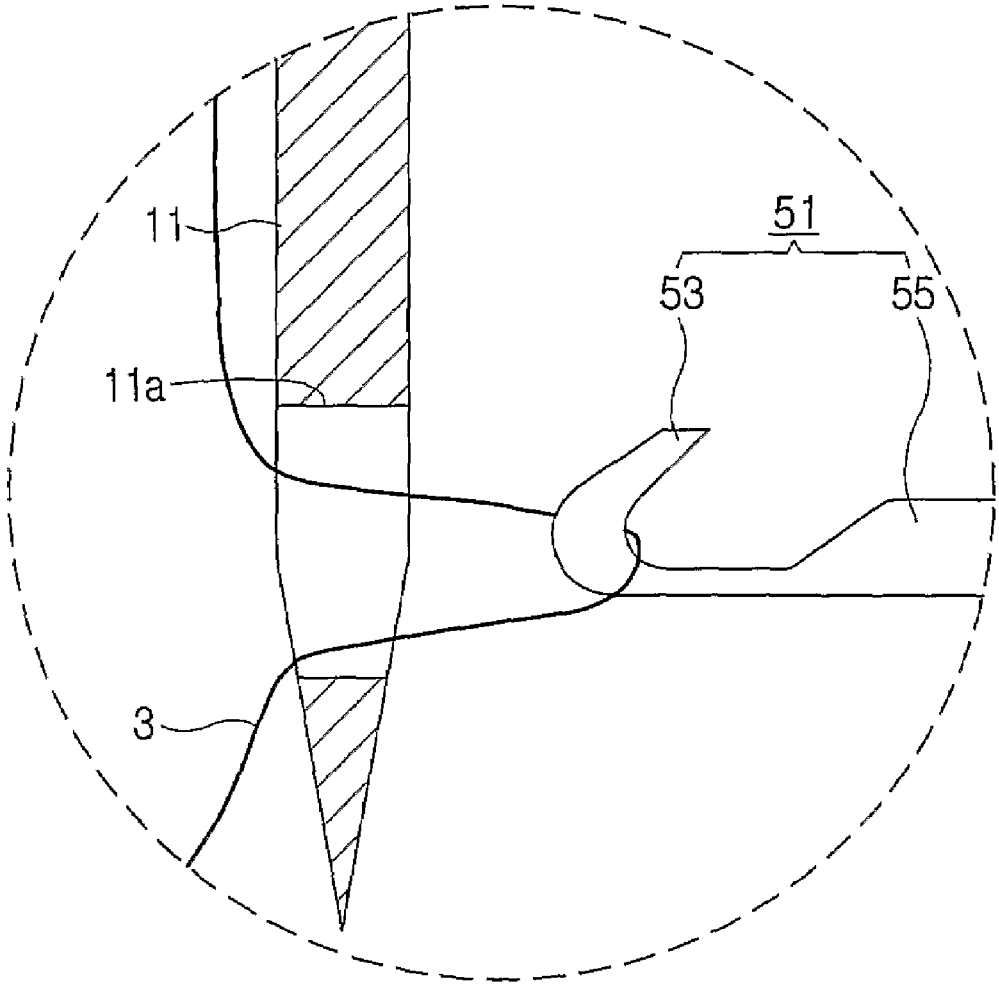

When the thread catcher supporter 65 is released from the pressure of the lower part of the driving link 85, the thread catcher supporter 65 moves toward the back of the main body 63 by the elasticity of the supporting shaft elastic member 73, and thus the thread catcher 51 supported by the thread catcher supporter 65 also moves toward the back of the main body 63. Therefore, the hook 53 of the thread catcher 51 gets out of the eye 11*a* of the needle 11 while holding the thread 3, i.e., returns back from the eye 11*a* of the needle 11, thereby being spaced from the needle 11 at a predetermined distance. At this time, the thread 3 passes through the eye 11*a* of the needle 11 and maintained to be held in the hook 53 of the thread catcher 51 as shown in FIG. 15C.

When the needle bar bush 23 is moves down from the threading work position to the threading aligning position, the lifting bar 35 is lifted down, so that the clutch operator 161 provided in the auxiliary bracket 143 is also lifted down.

As the clutch operator 161 is lifted down, the extended part 155 of the lifting clutch 151 locked to the groove 141*a* of the lifting rod 141 moves being in contact with the clutch cam profile 163 of the clutch operator 161 as shown in FIG. 15B. Therefore, the lifting rod 141 is delayed in down lifting by the contact with the clutch cam profile 163, and then presses the top surface of the rotation bracket 113, thereby returning the thread guiding bracket 119 to its original position.

Thus, while the lifting rod 141 being lifted down is delayed, the thread catcher supporter 65 moves toward the back of the main body 63, so that the thread 3 passes through the eye 11*a* of the needle 11 and is caught in the hook 53 of the thread catcher 51, and then the thread guiding bracket 119 returns to its original position.

As compared with the first embodiment, the needle threading machine 1' according to the second embodiment of the present invention more safely hooks the thread 3 on the hook 53, thereby putting the thread 3 through the eye 11*a* of the needle 11.

Thus, the thread guiding unit takes up the thread supplied from the thread supplying unit and hooks the thread on the hook passed through the eye of the needle, so that the thread is safely hooked on the hook and then put through the eye of the needle, thereby reducing a defective needle threading work and enhancing productivity.

Meanwhile, it will be appreciated by those skilled in the art that the present invention can be applied to various sewing machines such as a single needle automatic embroidering machine, a multi needle automatic embroidering machine, or the like.

As described above, the present invention provides a needle threading machine having an improved structure of safely hooking a thread on a hook, so that a defective needle threading work is reduced and productivity is enhanced.

What is claimed is:

1. A needle threading machine of putting a thread through an eye of a needle provided in a sewing machine, the needle treading machine comprising:

a thread supplying unit supplying the thread along a predetermined thread guiding path;

a thread catcher comprising a hook to hook the thread, and a hook supporter extended from the hook and supporting the hook;

a thread catcher driver driving the thread catcher to reciprocate allowing the hook to be inserted in and return from the eye of the needle;

a thread guiding unit hooking the thread supplied from the thread supplying unit on the hook passed through the eye of the needle;

a needle bar to which the needle is mounted, a lifting unit to lift up the needle bar from a sewing work section to a needle threading section for putting the thread through the eye of the needle, and a lifting driver to drive the lifting unit to be lifted up and down, wherein the thread catcher driver drives the hook to pass through the eye of the needle and the thread guiding unit hooks the thread on the hook passed through the eye of the needle as the lifting unit is lifted up within the needle threading section.

2. The needle threading machine according to claim 1, wherein the thread catcher driver comprises:

a main body;

a thread catcher supporter provided to reciprocate relative to the main body, and supporting the thread catcher;

a supporting shaft supporting the thread catcher supporter to reciprocate relative to the main body; and a reciprocating unit allowing the thread catcher supporter to reciprocate.

3. The needle threading machine according to claim 2, wherein the reciprocating unit comprises:

a driving pin provided in the lifting unit; and a driving link having a reciprocating profile formed at a predetermined angle transversely to a lifting direction of the needle to contact the driving pin as the lifting unit is lifted up within the needle threading section, and allowing the hook to be inserted in and return from the eye of the needle by pressing and releasing the thread catcher supporter as the driving pin moves contacting the reciprocating profile.

4. The needle threading machine according to claim 2, wherein the thread guiding unit comprises:

a rotation bracket rotatably coupled to the main body, and formed with a thread guiding profile;

a rotation pin protruding from the thread catcher supporter, contacting and moving along the thread guiding profile of the rotation bracket, and rotating the rotation bracket by reciprocation of the thread catcher supporter;

a thread guiding bracket to take up the thread supplied from the thread supplying unit and hook the thread on the hook; and an auxiliary link connecting the rotation bracket with the thread guiding bracket, and transferring the rotation of the rotation bracket to the thread guiding bracket.

5. The needle threading machine according to claim 2, wherein the thread guiding unit comprises:

a rotation bracket rotatably coupled to the main body;

a thread guiding bracket to take up the thread supplied from the thread supplying unit and hook the thread on the hook;

an auxiliary link connecting the rotation bracket with the thread guiding bracket, and transferring the rotation of the rotation bracket to the thread guiding bracket; and a rotation bracket elastic member provided between the main body and the rotation bracket, and elastically urging the rotation bracket to rotate allowing the thread taken up in the thread guiding bracket to be on the hook.

6. The needle threading machine according to claim 4, further comprising:

a lifting rod formed with a groove on an outer circumference thereof, and moving close to and apart from the rotation bracket by being lifted up and down along with the lifting unit;

a lifting clutch comprising a protrusion locked to the groove, and an extended part extended from the protrusion, and controlling the lifting operation of the lifting rod; and a clutch operator formed with a clutch cam profile being in contact with and apart from the extended part, and operating the lifting clutch to return the thread guiding bracket to an original position thereof after getting the hook holding the thread out of the eye of the needle as the protrusion is released from the groove by moving the extended part to be in contact with the clutch cam profile when the lifting rod is lifted down.

7. The needle threading machine according to claim 5, further comprising:

a lifting rod formed with a groove on an outer circumference thereof, and moving close to and apart from the rotation bracket by being lifted up and down along with the lifting unit;

a lifting clutch comprising a protrusion locked to the groove, and an extended part extended from the protrusion, and controlling the lifting operation of the lifting rod; and a clutch operator formed with a clutch cam profile being in contact with and apart from the extended part, and operating the lifting clutch to return the thread guiding bracket to an original position thereof after getting the hook holding the thread out of the eye of the needle as the protrusion is released from the groove by moving the extended part to be in contact with the clutch cam profile when the lifting rod is lifted down.

* * * * *